US005880089A

United States Patent [19]

Lentsch et al.

[11] Patent Number: 5,880,089

[45] Date of Patent: Mar. 9, 1999

[54] RINSE AID FOR PLASTICWARE

[75] Inventors: Steven E. Lentsch, St. Paul; Victor F. Man; Matthew J. Sopha, both of Minneapolis, all of Minn.

[73] Assignee: Ecolab Inc., St. Paul, Minn.

[21] Appl. No.: 841,198

[22] Filed: Apr. 29, 1997

Related U.S. Application Data

[63] Continuation-in-part of Ser. No. 390,532, Feb. 16, 1995, abandoned, which is a continuation-in-part of Ser. No. 304,571, Sep. 12, 1994, Pat. No. 5,603,776.

[51] Int. Cl.[6] ..... C11D 3/37; C11D 3/16; C11D 1/722

[52] U.S. Cl. ..... 510/514; 510/219; 510/222; 510/224; 510/228; 510/243; 510/400; 510/421; 510/423; 510/466; 510/504

[58] Field of Search ..... 510/514, 219, 510/222, 224, 228, 243, 400, 421, 423, 466, 504

[56] References Cited

U.S. PATENT DOCUMENTS

| | | | |
|---|---|---|---|
| 3,563,901 | 2/1971 | Crotty et al. | 510/514 |
| 3,629,127 | 12/1971 | Palmer et al. | 510/514 |
| 4,005,024 | 1/1977 | Rodriguez et al. | 510/514 |
| 4,089,804 | 5/1978 | Falk | 252/355 |
| 4,098,811 | 7/1978 | Falk | 260/459 A |
| 4,099,912 | 7/1978 | Ehrlich | 8/137 |
| 4,102,916 | 7/1978 | Falk | 260/501.12 |
| 4,167,488 | 9/1979 | Murtaugh | 510/434 |
| 4,171,282 | 10/1979 | Mueller | 252/356 |
| 4,239,915 | 12/1980 | Falk | 562/481 |
| 4,266,080 | 5/1981 | Falk et al. | 568/45 |
| 4,269,739 | 5/1981 | Grejsner | 510/417 |
| 4,302,348 | 11/1981 | Requejo | 510/429 |
| 4,310,698 | 1/1982 | Cooke | 510/514 |
| 4,416,794 | 11/1983 | Barrat et al. | 510/514 |
| 4,492,646 | 1/1985 | Welch | 510/423 |
| 4,511,489 | 4/1985 | Requejo et al. | 510/243 |
| 4,624,713 | 11/1986 | Morganson et al. | 134/25.2 |
| 4,654,161 | 3/1987 | Kollmeier et al. | 424/70.12 |
| 4,898,621 | 2/1990 | Pruehs et al. | 134/25.2 |
| 5,133,892 | 7/1992 | Chun et al. | 510/224 |
| 5,273,677 | 12/1993 | Arif | 510/514 |
| 5,298,289 | 3/1994 | Lindert et al. | 427/388.4 |
| 5,380,455 | 1/1995 | Tsuda et al. | 510/119 |
| 5,439,609 | 8/1995 | Paszek | 510/238 |
| 5,447,648 | 9/1995 | Steindorf | 510/514 |
| 5,501,815 | 3/1996 | Man | 510/514 |
| 5,514,302 | 5/1996 | Brown | 510/280 |
| 5,589,099 | 12/1996 | Baum | 510/514 |
| 5,603,776 | 2/1997 | Lentsch et al. | 134/25.2 |
| 5,714,453 | 2/1998 | Neumiller | 510/405 |

FOREIGN PATENT DOCUMENTS

| | | |
|---|---|---|
| 0 008 209 | 2/1980 | European Pat. Off. . |
| 0394211 | 10/1990 | European Pat. Off. . |
| 0 432 836 A2 | 6/1991 | European Pat. Off. . |
| 0 481 910 A1 | 4/1992 | European Pat. Off. . |
| 2106928 | 4/1983 | United Kingdom . |
| 2 200 365 | 8/1988 | United Kingdom . |
| 94/24253 | 10/1994 | WIPO . |

OTHER PUBLICATIONS

Otten et al., Anionic Hydrotropes for Industrial and Institutional Rinse Aids, JAOCS, vol. 63, No. 8, Aug. 1986, pp. 1078–1081.

Wilson, Rinse Additives, Soap and Chemical Specialties, Feb. 1958, pp. 48–52 and pp. 170–171.

Fluorad™ Fluorochemical Surfactant FC–170C, 3M Product Information, 3M 1993.

Fluorad™ Fluorochemical Surfactants, 3M Product Information, 3M 1993.

*SILWET® Surfactants*, Union Carbide Chemicals and Plastics Company Inc., 1992.

ABIL®, B 9950, Tego Cosmetics, Polysiloxane polyorganobetaine copolymer, 1989.

Silicones. ABIL® B 8842, ABIL® B 88183, ABIL® Polyether Polysiloxane Compolymers, Tego Cosmetics, Glenn Corporation, 1989.

Nonionic Surfactants, Edited by Martin J. Schick, Lever Brothers Co., Surfactant Science Series, Martin J. Schick and Frederick M. Fowkes, 1967, pp. 260–297.

*Primary Examiner*—Paul Lieberman
*Assistant Examiner*—Lorna M. Douyon
*Attorney, Agent, or Firm*—Merchant, Gould, Smith, Edell, Welter & Schmidt, P.A.

[57] ABSTRACT

A rinse aid composition for use on plasticware is herein described which requires lower concentration of conventional hydrocarbon surfactants, exhibits adequate sheeting on the plasticware and acceptable drying time which prior rinse aids have failed to provide without special handling. The compositions described contain hydrocarbon surfactants and a polyether or polybetaine polysiloxane copolymer surfactant in combination with a fluorinated hydrocarbon surfactant. The composition may be formulated as a solid or liquid suitable for dilution to form an aqueous rinse used to contact the plasticware in a warewashing machine.

15 Claims, No Drawings

RINSE AID FOR PLASTICWARE

CROSS-REFERENCE TO RELATED APPLICATION

This application is a continuation-in-part of application Ser. No. 08/390,532, filed Feb. 16, 1995, now abandoned, which is a continuation-in-part of application Ser. No. 08/304,571 filed Sep. 12, 1994, now U.S. Pat. No. 5,603,776.

FIELD OF THE INVENTION

The invention relates to warewashing processes and chemicals used in washing plastic cookware, dishware and flatware. More particularly, the invention relates to primarily organic materials that can be added to water to promote a sheeting action in an aqueous rinse used after an alkaline detergent cycle. Such aqueous rinse aids promote effective sheeting to result in removal of aqueous rinse materials and solids contained therein from plastic cookware, dishware and flatware in acceptable drying time without cracking the plasticware.

BACKGROUND OF THE INVENTION

Mechanical warewashing machines have been common in the institutional and household environments for many years. Such automatic warewashing machines clean dishes using two or more cycles which can include initially a wash cycle followed by a rinse cycle. Such dishwashers can also utilize soak cycle, prewash cycle, scrape cycle, second wash cycle, a rinse cycle, a sanitizing cycle and a drying cycle, if required. Such cycles can be repeated if needed and additional cycles can be used. After passing through a wash, rinse and dry cycle, dishware, cups, glasses, etc., can exhibit spotting that arises from the uneven draining of the water from the surface of the ware after the rinse step. Spotting is aesthetically unacceptable in most consumer and institutional environments.

In order to substantially prevent the formation of spotting rinse agents have commonly been added to water to form an aqueous rinse which is sprayed on the dishware after cleaning is complete. The precise mechanism through which rinse agents work is not established. One theory holds that the surfactant in the rinse aid is absorbed on the surface at temperatures at or above its cloud point, and thereby reduces the solid-liquid interfacial energy and contact angle. This leads to the formation of a continuous sheet which drains evenly from the surface and minimizes the formation of spots. Generally, high foaming surfactants have cloud points above the temperature of the rinse water, and, according to this theory, would not promote sheet formation, thereby resulting in spots. Moreover, high foaming materials are known to interfere with the operation of the warewashing machine. Common rinse aid formulas are used in an amount of less than about 1,000 parts preferably less than 500 parts, commonly 50 to 200 parts per million of active materials in the aqueous rinse. Rinse agents available in the consumer and institutional markets comprise liquid or solid forms which are typically added to, dispersed or dissolved in water to form an aqueous rinse. Such dissolution can occur from a rinse agent installed onto the dish rack. The rinse agent can be diluted and dispensed from a dispenser mounted on or in the machine or from a separate dispenser that is mounted separately but cooperatively with the dish machine.

Commonly available commercial rinse agents typically comprise a low foaming surface active agent made from homopolymers or copolymers of an alkylene oxide such as ethylene oxide or propylene oxide or mixtures thereof. Typically, the surfactants are formed by reacting an alcohol, a glycol, a carboxylic acid, an amine or a substituted phenol with various proportions and combinations of ethylene oxide and propylene oxide to form both random and block copolymer substituents.

The commonly available rinse agents have primarily focused on reducing spotting and filming on surfaces such as glass, ceramics, china and metal. However, plastic dishware is more commonly used now, especially in the institutional market. A special problem for rinse aid surfactants used for plasticware is the attack and crazing of the ware. Block copolymer surfactants do not seem to attack plastics as strongly as fatty alcohol or alkyl phenol-based nonionic surfactants. Linear alkoxylates show they do not attack plexiglass, polystyrene, or Tupperware®, common utensil plastics. Nevertheless, current surfactants have not provided the desired sheeting in an acceptable drying time following the rinse cycle.

U.S. Pat. No. 5,298,289 describes the treatment and after-treatment of surfaces, especially metals, with derivatives of polyphenol compounds. These compositions are also said to be useful in treating plastic and painted surfaces to improve rinsability without water breaks. The surfactants employed are a combination of previously known anionic and nonionic surfactants.

Liquid dishwashing detergent compositions are described in U.S. Pat. No. 4,452,646 containing highly ethoxylated nonionic surfactants to reduce spotting and filming on surfaces such as glass, ceramics and metal.

European Patent Publication 0,432,836 describes the use of alkyl polyglycoside surfactants in rinse aid compositions on polycarbonate.

Fluorinated surfactants are described in U.S. Pat. No. 4,089,804 where a non-ethoxylated fluoroaliphatic sulfonamide alcohol is added to typical fluorinated hydrocarbon surfactants as a synergist. The compositions are described as useful in a wide variety of industries, e.g., household cosmetic and personal products. Rinse aid for dishwashing is mentioned.

Certain organosilanes have been described in rinse aid compositions where the organosilane contains either a nitrogen, phosphorous or sulfur cationic group in combination with an anion, e.g. a monofunctional organic acid. U.S. Pat. No. 4,005,024 describes such compounds in a rinse aid composition to attract specific soil particles.

Aminosilanes have been described with a low foaming ethoxylated nonionic surfactant in rinse aid compositions in automatic dishwashing machines.

None of the fluorinated surfactants or silanes described in rinse aid compositions have focused on their use in plasticware.

Surprisingly, we have found that by adding a polyether or polybetaine polysiloxane nonionic or amphoteric surfactant alone or in combination with a fluorinated hydrocarbon surfactant, especially an ethoxylated fluorinated aliphatic sulfonamide alcohol, to a conventional rinse aid composition containing hydrocarbon surfactants, the resulting rinse agent provides excellent sheeting properties on plasticware without attacking or crazing the plastic and, more importantly, providing dried, non-spotted plasticware in acceptable time following the rinse cycle.

SUMMARY OF THE INVENTION

Accordingly, the present invention is a rinse aid composition for plasticware, formulated as a dilutable liquid, gel or solid concentrate and, when diluted, forming an aqueous rinse, and including in addition to conventional rinse aid surfactants, e.g. hydrocarbon surfactants, about 0.1 to 10 wt-% of a polyalkylene oxide-modified polydimethylsiloxane or a polybetaine-modified polysiloxane, in combination with about 0.1 to 10 wt-% of a fluorinated hydrocarbon nonionic surfactant.

A second aspect of the present invention is a method of cleaning plasticware by: (a) first contacting the ware with an alkaline aqueous cleaning agent in a warewashing machine at 100°–180° F. to produce cleaned plasticware, and (b) contacting the cleaned plasticware with an aqueous rinse containing a major proportion of an aqueous diluent having about 2 to 100 parts per million of hydrocarbon surfactants, and about 0.01 to 10 parts per million of a polyalkylene oxide-modified polydimethylsiloxane or polybetaine-modified polysiloxane, optionally in combination with about 0.01 to 10 parts per million of a fluorinated hydrocarbon surfactant, e.g. an ethoxylated fluoroaliphatic sulfonamide alcohol.

DETAILED DESCRIPTION OF THE INVENTION

For the purpose of this invention, the term "rinse agent" includes concentrate materials that are diluted with an aqueous stream to produce an aqueous rinse. Accordingly, an aqueous rinse agent is an aqueous material that is contacted with ware in a rinse cycle. A sheeting agent is the polymeric material used to promote the even draining of the aqueous rinse. Sheeting is defined as forming a continuous, evenly draining film, leaving virtually no spots or film upon the evaporation of water. For the purpose of this invention, the term "dish" or the term "ware" is used in the broadest sense of the term to refer to various types of articles used in the preparation, serving, consumption, and disposal of food stuffs including pots, pans, trays, pitchers, bowls, plates, saucers, cups, glasses, forks, knives, spoons, spatulas, and other glass, metal, ceramic, plastic composite articles commonly available in the institutional or household kitchen or dining room.

Since the present invention focuses on plastic articles, the term "plasticware" includes the above articles made from, e.g., polycarbonate, melamine, polypropylene, polyester resin, polysulfone, and the like.

The siloxane surfactant employed as an additive in the present invention alone or in combination with a fluorochemical surfactant described below is a polyalkylene oxide-modified polydimethylsiloxane, nonionic surfactant or a polybetaine-modified polysiloxane amphoteric surfactant. Both, preferably, are linear polysiloxane copolymers to which polyethers or polybetaines have been grafted through a hydrosilation reaction. This process results in an alkyl-pendant (AP type) copolymer, in which the polyalkylene oxide groups, for example, are attached along the siloxane backbone through a series of hydrolytically stable Si-C bonds. These products have the general formula:

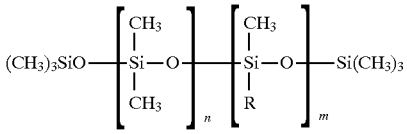

wherein R is $—(CH_2)_3—O—(EO)_x—(PO)_y—Z$ or

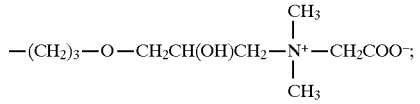

EO is ethyleneoxy, PO is 1,2-propyleneoxy, Z is hydrogen or alkyl of 1–6 carbon atoms, and the weight ratio in % of EO:PO may vary from 100:0 to 0:100. A broad range of surfactants have been developed varying x and y above and coefficients n and m. Preferably, n is 0 or ≧1 and m is at least 1. More preferred are the siloxanes where Z is hydrogen, methyl or butyl and the weight ratio of EO:PO is 100:0 to 40:60. Particularly valuable are the siloxane surfactants herein described and known as SILWET® surfactants available from Union Carbide or ABIL® polyether or polybetaine polysiloxane copolymers available from Goldschmidt Chemical Corp. The particular siloxanes used in the present invention are described as having, e.g., low surface tension, high wetting ability and excellent lubricity. For example, these surfactants are said to be among the few capable of wetting polytetrafluoroethylene surfaces.

The fluorochemical surfactant employed as an additive in the present invention in combination with a silane, defined above, is a nonionic fluorohydrocarbon, such as, for example, fluorinated alkyl polyoxyethylene ethanols, fluorinated alkyl alkoxylate and fluorinated alkyl esters. These Fluorad™ surfactants are available from 3M. As a fluorinated alkyl polyoxyethylene ethanol, included as a preferred surfactant is a polyoxyethylene adduct of a fluoroaliphatic sulfonamide alcohol which has excellent wetting, spreading and levelling properties. These surfactants may be described as having the formula:

$$R_fSO_2N(C_2H_5)(CH_2CH_2O)_xH$$

wherein $R_f$ is $C_nF_{2n+1}$ in which n is 6–10 and x may vary from 10 to 20. Particularly valuable is the surfactant where n is 8 and x is 14. This particular surfactant identified as FC-170C is also available from 3M.

Although fluorocarbon surfactants and silicone surfactants have been known to be good wetting agents and used individually in rinse aid formulations, there is no description of their being used effectively in plasticware as rinse aids. We have found in the present invention that the use of certain polysiloxane copolymers in a mixture with hydrocarbon surfactants provide excellent rinse aids on plasticware. We have also found that the combination of certain silicone polysiloxane copolymers and fluorocarbon surfactants with conventional hydrocarbon surfactants also provide excellent rinse aids on plasticware. This combination has been found to be better than the individual components except with certain polyalkylene oxide-modified polydimethylsiloxanes and polybetaine polysiloxane copolymers of the present invention where the effectiveness is about equivalent. Therefore, the preferred embodiments of the present invention encompass the polysiloxane copolymers alone and the combination with the fluorocarbon surfactant preferably involves polyether polysiloxanes, the nonionic siloxane surfactants. The amphoteric siloxane surfactants, the polybetaine polysiloxane copolymers may be employed alone as the additive in the conventional rinse aids to provide the same results.

Since the use of the above siloxane additives alone or in combination with the fluorocarbon are applicable to all conventional rinse aid formulations, the following description of ingredients and rinse aid formulations is illustrative only and not limiting of the present invention.

An example of hydrocarbon surfactants in conventional rinse aid formulations are nonionic surfactants, typically a polyether compound prepared from ethylene oxide, propylene oxide, in a homopolymer or a block or heteric copolymer. Such polyether compounds are known as polyalkylene oxide polymers, polyoxyalkylene polymers, or polyalkylene glycol polymers. Such sheeting or rinse agents have a molecular weight in the range of about 500 to about 15,000. Certain types of polyoxypropylene-polyoxyethylene glycol polymer rinse aids have been found to be particularly useful. Those surfactants comprising at least one block of a polyoxypropylene and having at least one other block of polyoxyethylene attached to the polyoxypropylene block. Additional blocks of polyoxyethylene or polyoxypropylene can be present in a molecule. These materials having an average molecular weight in the range of about 500 to about 15,000 are commonly available as PLURONIC® manufactured by the BASF Corporation and available under a variety of other trademarks of their chemical suppliers. In addition, rinse aid compositions called PLURONIC® R (reverse pluronic structure) are also useful in the rinse aids of the invention. Additionally, rinse aids made by reacting ethylene oxide or propylene oxide with an alcohol anion and an alkyl phenol anion, a fatty acid anion or other such anionic material can be useful. One particularly useful rinse aid composition can comprise a capped polyalkoxylated $C_{6-24}$ linear alcohol. The rinse aids can be made with polyoxyethylene or polyoxypropylene units and can be capped with common agents forming an ether end group. One particularly useful species of this rinse aid is a benzyl ether of a polyethoxylated $C_{12-14}$ linear alcohol; see U.S. Pat. No. 3,444,247. Alcohol ethoxylates having EO and PO blocks can be particularly useful since the stereochemistry of these compounds can permit occlusion by urea, a feature useful in preparing solid rinse aids.

Particularly useful polyoxypropylene polyoxyethylene block polymers are those comprising a center block of polyoxypropylene units and blocks of polyoxyethylene units to each side of the center block. These copolymers have the formula shown below:

$$(EO)_n\text{-}(PO)_m\text{-}(EO)_n$$

wherein m is an integer of 21 to 54; n is an integer of 7 to 128. Additional useful block copolymers are block polymers having a center block of polyoxyethylene units and blocks of polyoxypropylene units to each side of the center block. The copolymers have the formula as shown below:

$$(PO)_n\text{-}(EO)_m\text{-}(PO)_n$$

wherein m is an integer of 14 to 164 and n is an integer of 9 to 22.

In the preparation of conventional rinse aid compositions, a hydrotropic agent is often employed in the formulation. Such an agent may also be used in the present invention.

Hydrotropy is a property that relates; to the ability of materials to improve the solubility or miscibility of a substance in liquid phases in which the substance tends to be insoluble. Substances that provide hydrotropy are called hydrotropes and are used in relatively lower concentrations than the materials to be solubilized.

A hydrotrope modifies the solvent to increase the solubility of an insoluble substance or creates micellar or mixed micellar structures resulting in a stable suspension of the insoluble substance in the solvent. The hydrotropic mechanism is not thoroughly understood. Apparently either hydrogen bonding between primary solvent, in this case water, and the insoluble substance are improved by the hydrotrope or the hydrotrope creates a micellar structure around the insoluble composition to maintain the material in a suspension/solution. In this invention, the hydrotropes are most useful in maintaining a uniform solution of the cast rinse composition both during manufacture and when dispersed at the use location. The combination of the polyalkylene oxide materials and the casting aids tends to be partially incompatible with aqueous solution and can undergo a phase change or phase separation during storage of the solution. The hydrotrope solubilizer maintains the rinse composition in a single phase solution having the nonionic rinsing agent uniformly distributed throughout the composition.

Preferred hydrotrope solubilizers are used at about 0.1 to 20 wt-% and include small molecule anionic surfactants. The most preferred hydrotrope solubilizers are used at about 1 to 10 wt-% and include aromatic sulfonic acid or sulfonated hydrotropes such as $C_{1-5}$ substituted benzene sulfonic acid or naphthalene sulfonic acid. Examples of such a hydrotrope are xylene sulfonic acid or naphthalene sulfonic acid or salts thereof. Such materials do not provide any pronounced surfactant or sheeting activity but significantly improve the solubility of the organic materials of the rinse aid in the aqueous rinse compositions.

Thus, a preferred embodiment of a rinse aid composition for plasticware, which is suitable for dilution to form an aqueous rinse includes: (a) about 2 to 90 wt-% of one or more nonionic surfactants; (b) about 1 to 20 wt-% of a hydrotrope; (c) about 0.1 to 10 wt-% of a polysiloxane copolymer of the formula

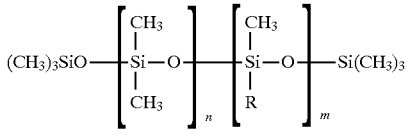

wherein R is $—(CH_2)_3—O—(EO)_x—(PO)_y—Z$ or

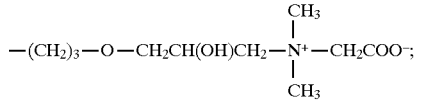

n is 0 or ≧1; m is at least 1, Z is hydrogen or alkyl of 1–6 carbon atoms, and the weight ratio in % of EO:PO may vary from 100:0 to 0:100, and, optionally, (d) about 0.1 to 10 wt-% of an ethoxylated fluoroaliphatic sulfonamide alcohol.

Another embodiment of the rinse aid composition of the present invention is the above-described siloxane surfactant with a rinse aid composition containing a nonionic block copolymer and a defoamer composition, and, optionally, in combination with the above-described fluorocarbon surfactant. The nonionic ethylene oxide propylene oxide block copolymer in this case would not have been expected to provide effective sheeting action and low foam in an aqueous rinse due to its high cloud point and poor wetting properties. However, rinse agents diluted into an aqueous rinse providing effective sheeting and low foaming properties have been prepared from high cloud point, high foaming surfactants with an appropriate defoamer as described in copending U.S. application Ser. No. 08/049,973 of Apr. 20, 1993.

Illustrative but non-limiting examples of various suitable high cloud point nonionic surface active agents for these rinse agents include polyoxyethylene-polyoxypropylene block copolymers having the formula:

$(EO)_x(PO)_y(EO)_z$ wherein x, y and z reflect the average molecular proportion of each alkylene oxide monomer in the overall block copolymer composition. x typically ranges from about 30 to 130, y typically ranges from about 30 to 70, z typically ranges from about 30 to 130, and x plus y is typically greater than about 60. The total polyoxyethylene component of the block copolymer constitutes typically at least about 40 mol-% of the block copolymer and commonly 75 mol-% or more of the block copolymer. The material preferably has a molecular weight greater than about 1,000 and more preferably greater than about 2,000.

Defoaming agents (defoamers) include a variety of different materials adapted for defoaming a variety of compositions. Defoamers can comprise an anionic or nonionic material such as polyethylene glycol, polypropylene glycol, fatty acids and fatty acid derivatives, fatty acid sulfates, phosphate esters, sulfonated materials, silicone based compositions, and others.

Preferred defoamers are food additive defoamers including silicones and other types of active anti-foam agents.

Silicone foam suppressors include polydialkylsiloxane preferably polydimethylsiloxane. Such silicone based foam suppressors can be combined with silica. Such silica materials can include silica, fumed silica, derivatized silica, silanated silica, etc. Commonly available anti-foaming agents combine a polydimethylsiloxane and silica gel. Another food additive defoaming agent comprises a fatty acid defoamer. Such defoamer compositions can comprise simple alkali metal or alkaline earth metal salts of a fatty acid or fatty acid derivatives. Examples of such derivatives include mono, di- and tri- fatty acid esters of polyhydroxy compounds such as ethylene glycol, glycerine, propylene glycol, hexylene glycol, etc. Preferably such defoaming agents comprise a fatty acid monoester of glycerol. Fatty acids useful in such defoaming compositions can include any $C_{8-24}$ saturated or unsaturated, branched or unbranched mono or polymeric fatty acid and salts thereof, including for example myristic acid, palmitic acid, stearic acid, behenic acid, lignoceric acid, palmitoleic acid, oleic acid, linoleic acid, arachidonic acid, and others commonly available. Other food additive anti-foam agents available include water insoluble waxes, preferably microcrystalline wax, petroleum wax, synthetic petroleum wax, rice base wax, beeswax having a melting point in the range from about 35° to 125° C. with a low saponification value, white oils, etc. Such materials are used in the rinse agents at a sufficient concentration to prevent the accumulation of any measurable stable foam within the dish machine during a rinse cycle. The defoaming composition may be present in the composition of the present invention from about 0.1–30 wt-%, preferably 0.2–25 wt-%.

Thus, a preferred rinse aid composition for plasticware, suitable for dilution to form an aqueous rinse also includes: (a) about 5 to 40 wt-% of a nonionic block copolymer composition of ethylene oxide and propylene oxide, having a molecular weight of ≧5000 and a cloud point, measured with a 1 wt-% aqueous solution, greater than 50° C.; (b) about 0.2 to 25 wt-% of a food additive defoamer composition; (c) about 0.1 to 10 wt-% of a polysiloxane copolymer of the formula

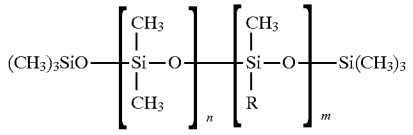

wherein R is $—(CH_2)_3—O—(EO)_x—(PO)_y—Z$ or

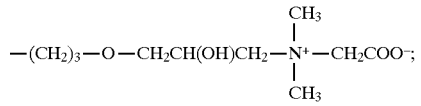

n is 0 or ≧1; m is at least 1, Z is hydrogen or alkyl of 1–6 carbon atoms, and the weight ratio in % of EO:PO may vary from 100:0 to 0:100, and, optionally, (d) about 0.1 to 10 wt-% of an ethoxylated fluoroaliphatic sulfonamide alcohol.

Still another embodiment of the present invention is a rinse aid composition containing the above-described siloxane surfactant with a rinse aid composition containing solely food additive ingredients and, optionally, in combination with the above-described fluorocarbon surfactant. The compositions include a class of nonionic surfactants, namely, the polyalkylene oxide derivatives of sorbitan fatty acid esters, which exhibit surprising levels of sheeting action, with a careful selection of defoamer compositions. These are described in copending U.S. application Ser. No. 08/050,531 of Apr. 20, 1993. The effective defoamer compositions are selected from the group consisting of a silicone defoamer, an alkali metal (e.g. sodium, potassium, etc.) or alkaline earth fatty acid salt defoamer or a glycerol fatty acid monoester defoamer described above. Preferably, silicone based materials are used to defoam the sorbitan material.

Sorbitol and sorbitan can be derivatized with an alkylene oxide such as ethylene oxide or propylene oxide or derivatized with fatty acids or with both using conventional technology to produce nonionic surfactant sheeting agent materials. These sheeting agents are typically characterized by the presence of from 1 to 3 moles of a fatty acid, in ester form, per mole of surfactant and greater than 15 moles of alkylene oxide, preferably 15 to 40 moles of alkylene oxide and most preferably 15 to 25 moles of ethylene oxide per mole of surfactant. The composition of the surfactant is a mixture of a large number of compounds characterized by the molar proportion of alkylene oxide and the molar proportion of fatty acid residues on the sorbitol or sorbitan molecules. The compositions are typically characterized by average concentrations of the alkylene oxide (typically ethylene oxide) and the fatty acid on the overall compositions. Examples of preferred nonionic surfactants are Polysorbate 20®, also known as Tween 20® (ICI), typically considered to be a mixture of laureate esters of sorbitol and sorbitan consisting predominantly of the mono fatty acid ester condensed with approximately 20 moles of ethylene oxide. Polysorbate 60® is a mixture of stearate esters of sorbitol and sorbitan consisting predominantly of the mono fatty acid ester condensed with approximately 20 moles of ethylene oxide. Selected polysorbate nonionic surfactant materials are approved for direct use in food intended for human consumption under specified conditions and levels of use.

Alkoxylated sorbitan or sorbitol aliphatic esters suitable for use in the rinse aid composition include any sorbitan or sorbitol aliphatic ester derivatized with an alkylene oxide capable of providing effective sheeting action or rinsing performance in cooperation with the other components of the rinse agent composition. The preferred compositions are the ethylene oxide condensates with sorbitan or sorbitol fatty acid esters. In addition to providing superior sheeting and rinsing performance, these materials are approved food additives, in the form of a liquid or waxy solid, that can be easily formulated into concentrated liquid or solid rinse agents. Alkoxylated sorbitan or sorbitol fatty acid esters suitable for use in the rinse agent include mono, di- and tri-esters and mixtures thereof. Sorbitan fatty acid esters may be derivatized by esterification of sorbitol or sorbitan with such fatty acids as lauric, myristic, palmitic, stearic, oleic, linoleic, and other well known similar saturated, unsaturated (cis or trans), branched and unbranched fatty acid. Preferred food additive or GRAS fatty acids are the sorbitan esters approved as direct food additives (e.g. sorbitan monostearate, POE 20 Sorbitan monolaurate, POE 20 Sorbitan monostearate, POE 20 Sorbitan tristearate, POE 20 Sorbitan monooleate and mixtures thereof. Based on their cost availability and ability to provide excellent sheeting action and rinsing performance, the preferred useful ethoxylated sorbitan or sorbitol fatty acid ester include monoesters derivatized with ethylene oxide.

Thus, a preferred rinse aid composition for plasticware, suitable for dilution to form an aqueous rinse, further includes: (a) about 5 to 50 wt-% of a sorbitan fatty acid ester containing greater than about 15 moles of alkylene oxide per mole of sorbitan; (b) about 0.2 to 25 wt-% of a defoamer composition selected from the group consisting of an alkali metal or alkaline earth metal salt of a fatty acid, a silicone, a fatty acid ester of glycerol, and mixtures thereof; (c) about 0.1 to 10 wt-% of a polysiloxane copolymer of the formula

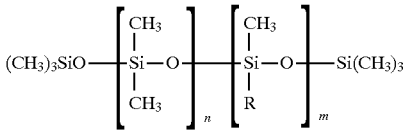

wherein R is $—(CH_2)_3—O—(EO)_x—(PO)_y—Z$ or

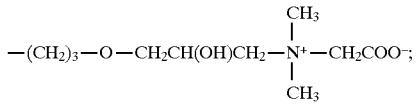

n is 0 or ≧1; m is at least 1, Z is hydrogen or alkyl of 1–6 carbon atoms, and the weight ratio in % of EO:PO may vary from 100:0 to 0:100, and, optionally, (d) about 0.1 to 10 wt-% of an ethoxylated fluoroaliphatic sulfonamide alcohol.

The rinse agents of the invention can, if desired, contain a polyvalent metal completing or chelating agent that aids in reducing the harmful effects of hardness components in service water. Typically calcium, magnesium, iron, manganese, etc., ions present in service water can interfere with the action of either washing compositions or rinsing compositions. A chelating agent can effectively complex and remove such ions from inappropriate interaction with active ingredients increasing rinse agent performance. Both organic and inorganic chelating agents are common. Inorganic chelating agents include such compounds as sodium tripolyphosphate and higher linear and cyclic polyphosphate species. Organic chelating agents include both polymeric and small molecule chelating agents. Polymeric chelating agents commonly comprise polyanionic compositions such as polyacrylic acid compounds. Small molecule organic chelating agents include salts of ethylenediaminetetracetic acid and hydroxyethylenediaminetetracetic acid, nitrilotriacetic acid, ethylenediaminetetrapropionates, triethylenetetraminehexacetates, and the respective alkali metal ammonium and substituted ammonium salts thereof. Amino phosphates are also suitable for use as chelating agents in the composition of the invention and include ethylenediamine(tetramethylene phosphates), nitrilotrismethylenephosphonates, diethylenetriamine (pentamethylenephosphonates). These amino phosphonates commonly contain alkyl or alkyl groups with less than 8 carbon atoms. Preferred chelating agents include approved food additive chelating agents such as disodium salt of ethylenediaminetetracetic acid.

The liquid rinse agent compositions of the invention have a liquid base component which can function as a carrier with various aqueous diluents to form the aqueous rinse. Liquid bases are preferably water or a solvent compatible with water to obtain compatible mixtures thereof. Exemplary nonlimiting solvents in addition to water include low molecular weight $C_{1-6}$ primary and secondary mono, di-, and trihydrate alcohol such as ethanol, isopropanol, and polyols containing from two to six carbon atoms and from two to six hydroxyl groups such as propylene glycol, glycerine, 1,3-propane diol, propylene glycol, etc.

The compositions of the invention can be formulated using conventional formulating equipment and techniques. The compositions of the invention typically can comprise proportions as set forth in Table I.

In the manufacture of the liquid rinse agent of the invention, typically the materials are manufactured in commonly available mixing equipment by charging to a mixing chamber the liquid diluent or a substantial proportion of a liquid diluent. Into a liquid diluent is added preservatives or other stabilizers. Care must be taken in agitating the rinse agent as the formulation is completed to avoid degradation of polymer molecular weight or exposure of the composition to elevated temperatures. The materials are typically agitated until uniform and then packaged in commonly available packaging and sent to storage before distribution.

The liquid materials of the invention can be adapted to a solid block rinse by incorporating into the composition a casting agent. Typically organic and inorganic solidifying materials can be used to render the composition solid. Preferably organic materials are used because inorganic compositions tend to promote spotting in a rinse cycle. The most preferred casting agents are polyethylene glycol and an inclusion complex comprising urea and a nonionic polyethylene or polypropylene oxide polymer. Polyethylene glycols (PEG) are used in melt type solidification processing by uniformly blending the sheeting agent and other components with PEG at a temperature above the melting point of the PEG and cooling the uniform mixture. An inclusion complex solidifying scheme is set forth in Morganson et al., U.S. Pat. No. 4,647,258.

The organic nature of the rinse agents of the invention can be subject to decomposition and microbial attack. Preferred stabilizers that can limit oxidative decomposition or microbial attack include food grade stabilizers, food grade antioxidants, etc. Most preferred materials for use in stabilizing the compositions of the invention include $C_{1-10}$ mono, di- and tricarboxylic acid compounds. Preferred examples of such acids include acetic acid, citric acid, lactic, tartaric, malic, fumaric, sorbic, benzoic, etc.

Optional ingredients which can be included in the rinse agents of the invention in conventional levels for use include solvents, processing aids, corrosion inhibitors, dyes, fillers, optical brighteners, germicides, pH adjusting agents (monoethanol amine, sodium carbonate, sodium hydroxide, hydrochloride acid, phosphoric acid, etc.), bleaches, bleach activators, perfumes and the like.

The range of actives in the solid and liquid concentrate compositions of the invention are set forth in Table I and the ranges in the aqueous rinse in Table II.

TABLE I

| (wt—%) Actives | Useful (wt—%) | Liquid | Preferred Solid |
|---|---|---|---|
| Hydrocarbon surfactant | 2–90 | 8–30 | 5–75 |
| Fluorocarbon surfactant | 0.1–10 | 0.5–5 | 0.5–5 |
| Siloxane surfactant | 0.1–10 | 0.5–5 | 0.5–5 |

TABLE II

| Actives | Useful (ppm) | Preferred (ppm) |
|---|---|---|
| Hydrocarbon surfactant | 2–200 | 20–150 |
| Fluorocarbon surfactant | 0.01–10 | 0.1–1.0 |
| Siloxane surfactant | 0.01–10 | 0.1–3.0 |

Liquid rinse agents of the invention are typically dispensed by incorporating compatible packaging containing the liquid material into a dispenser adapted to diluting the liquid with water to a final use concentration wherein the active material is present in the aqueous rinse as shown in Table II above in parts per million parts of the aqueous rinse. Examples of dispensers for the liquid rinse agent of the invention are DRYMASTER-P sold by Ecolab Inc., St. Paul, Minn.

Solid block products may be conveniently dispensed by inserting a solid block material in a container or with no enclosure into a spray-type dispenser such as the volume SOL-ET controlled ECOTEMP Rinse Injection Cylinder system manufactured by Ecolab Inc., St. Paul, Minn. Such a dispenser cooperates with a warewashing machine in the rinse cycle. When demanded by the machine, the dispenser directs a spray of water onto the solid block of rinse agent which effectively dissolves a portion of the block creating a concentrated aqueous rinse solution which is then fed directly into the rinse water forming the aqueous rinse. The aqueous rinse is then contacted with the dishes to affect a complete rinse. This dispenser and other similar dispensers are capable of controlling the effective concentration of the active block copolymer and the additives in the aqueous rinse by measuring the volume of material dispensed, the actual concentration of the material in the rinse water (an electrolyte measured with an electrode) or by measuring the time of the spray on the solid block.

The following examples and data further illustrate the practice of the invention. These should not be taken as limiting the invention and contain the best mode.

EXAMPLE I

The following four liquid formulations were prepared by routine mixing of the ingredients.

| Item | Raw Material | Formula No. (wt. %) 1 | 2 | 3 | 4 |
|---|---|---|---|---|---|
| 1 | EO/PO Block Terminated with PO (32% EO) | 19.300 | 19.720 | 19.633 | 19.461 |
| 2 | EO/PO Block Terminated with PO (39% EO) | 52.309 | 54.147 | 53.908 | 53.436 |
| 3 | Fluorad ™ FC-170C | | 0.887 | | 0.875 |
| 4 | Silwet ® L-77* | | | 1.325 | 1.313 |

-continued

| Item | Raw Material | Formula No. (wt. %) 1 | 2 | 3 | 4 |
|---|---|---|---|---|---|
| 5 | $C_{14-15}$ linear primary alcohol ethoxylate | 5.000 | 5.067 | 5.044 | 5.000 |
| 6 | Inerts to 100% | | | | |

*Siloxane of the formula described above where Z is methyl, n is 0, m is 1 and the weight ratio in % of EO:PO is 100:0.

These formulations were evaluated in a modified Champion 1 KAB dishwash machine modified to replace the front stainless panel with a glass window and to conduct rinsing tests using the machine pump and wash arms.

The test procedure is first to select appropriate test substrates to evaluate the test formulations. These substrates are typical pieces of plasticware commonly used in institutional accounts. In preparation for the sheeting test, the test substrates are conditioned with 0.2% Hotpoint soil in softened water at 160° F. for three minutes in the modified Champion 1 KAB dishmachine. The test procedure is to add test rinse aid in increments of 10 ppm actives, to the machine pump, circulate the test solution at 160° F. for 30 seconds, turn off the machine and observe the type of water break on each test substrate. There are three types of water break. These are:

0. No Sheeting. The test solution runs off the test substrate leaving discrete droplets behind.
1. Pinhole Sheeting. The test solution drains off of the test substrate to leave a continuous film. The film contains pinholes on the surface of the film. No droplets remain on the test substrate after the film drains and dries.
2. Complete Sheeting. The test solution drains off the test substrate to leave a continuous film with no pinholes. No droplets remain on the test substrate after the film drains and dries.

The type of water used in this test is softened well water. After each evaluation of test rinse aid per 10 ppm active increment, the results are recorded for each test substrate. The test continues until a good performance profile is obtained that allows a judgment to be made regarding the relative performance of the test formulations.

Results are given below in table form for each of the four formulations noted above.

Tables 1–4

Table 1 contains results for a commercially available rinse aid. Note that none of the plastic substrates exhibit complete sheeting until 70 ppm actives are used.

Table 2 contains results for the same set of actives containing Fluorad™ FC-170C. It performs marginally better at 60 ppm to complete sheet on some of the plastic substrates.

Table 3 contains results for the same set of actives containing Silwet® L-77. It also performs marginally better at 60 ppm to complete sheet on some of the plastic substrates.

Table 4 contains results for the invention. This contains both Silwet® L-77 and Fluorad™ FC-170C. It performs much better at 40 ppm to complete sheet on several of the plastic substrates.

The invention represented as Formulation 4 was also evaluated in four institutional test accounts relative to the commercially available rinse aid represented as Formulation 1. In each account at either the same or even at a lower concentration, there has been a significant improvement in drying results on plasticware. With the commercially available product large residual droplets of rinse water remained on the plasticware so that the dry time was much too long, i.e., the plasticware was stacked wet. With the invention, the dry time was greatly reduced and the plasticware was stacked dry.

TABLE 1

Formula 1
Soft water, 160° F., Hotpoint Soiled Dishes. (—) no sheeting, (|) pinhole sheeting, (X) complete sheeting.

| Parts Per Million Actives | 0 | 10 | 20 | 30 | 40 | 50 | 60 | 70 | 80 | 90 | 100 |
|---|---|---|---|---|---|---|---|---|---|---|---|
| PC Bowl | — | — | — | — | — | — | \| | X | X | X | X |
| PC Tile | — | — | — | — | — | — | \| | \| | X | X | X |
| Glass | — | — | — | — | \| | \| | \| | X | X | X | X |
| China Plate | — | — | — | — | — | \| | \| | \| | \| | X | X |
| Mel Plate | — | — | — | — | — | \| | \| | X | X | X | X |
| P3 Plate | — | — | — | — | — | \| | \| | X | X | X | X |
| P3 Cup | — | — | — | — | \| | \| | \| | X | X | X | X |
| Dnx Cup | — | — | — | — | — | \| | \| | X | X | X | X |
| Dnx Bowl | — | — | — | — | — | \| | \| | X | X | X | X |
| P3 Jug | — | — | — | — | — | \| | \| | \| | \| | \| | \| |
| Poly Try | — | — | — | — | \| | \| | \| | X | X | X | X |
| PS (dish) | — | — | — | — | — | — | \| | \| | \| | X | X |
| PS Spoon | — | — | — | — | — | — | \| | \| | \| | \| | X |
| SS Knife | — | — | — | — | — | \| | X | X | X | X | X |
| Temp °F. | 160 | 160 | 160 | 160 | 160 | 160 | 160 | 160 | 160 | 160 | 160 |
| Foam °F. | 0 | 0 | 0 | 0 | 0 | 0 | 0 | 0 | 0 | 0.2 | 0.3 |

TABLE 2

Formula 2
Formula 1 with FC-170-C and no Silwet ® L-77
Soft water, 160° F., Hotpoint Soiled Dishes. (—) no sheeting, (|) pinhole sheeting, (X) complete sheeting.

| Parts Per Million Actives | 0 | 10 | 20 | 30 | 40 | 50 | 60 | 70 | 80 | 90 | 100 |
|---|---|---|---|---|---|---|---|---|---|---|---|
| PC Bowl | — | — | — | — | — | — | \| | \| | \| | \| | X |
| PG Tile | — | — | — | — | — | — | — | \| | \| | \| | X |
| Glass | — | — | — | — | — | \| | \| | X | X | X | X |
| China Plate | — | — | — | — | — | \| | \| | X | X | X | X |
| Mel Plate | — | — | — | — | — | \| | \| | X | X | X | X |
| P3 Plate | — | — | — | — | — | \| | \| | X | X | X | X |
| P3 Cup | — | — | — | — | \| | \| | X | X | X | X | X |
| Dnx Cup | — | — | — | — | \| | \| | X | X | X | X | X |
| Dnx Bowl | — | — | — | — | \| | \| | X | X | X | X | X |
| P3 Jug | — | — | — | — | — | — | \| | \| | \| | \| | \| |
| Poly Try | — | — | — | — | — | \| | X | X | X | X | X |
| PS (dish) | — | — | — | — | — | — | \| | \| | \| | \| | \| |
| PS Spoon | — | — | — | — | — | — | — | \| | \| | \| | \| |
| SS Knife | — | — | — | — | — | — | — | X | X | X | |
| Temp °F. | 160 | 160 | 160 | 160 | 160 | 160 | 160 | 160 | 160 | 160 | 160 |
| Foam °F. | 0 | 0 | 0 | 0 | 0 | 0 | 0 | 0 | 0 | 0 | 0 |

TABLE 3

Formula 3
Formula 1 with Silwet ® L-77 and no FC-170-C
Soft water, 160° F., Hotpoint Soiled Dishes. (—) no sheeting, (|) pinhole sheeting, (X) complete sheeting.

| Parts Per Million Actives | 0 | 10 | 20 | 30 | 40 | 50 | 60 | 70 | 80 | 90 | 100 |
|---|---|---|---|---|---|---|---|---|---|---|---|
| PC Bowl | — | — | — | — | — | — | — | \| | X | X | X |
| PC Tile | — | — | — | — | — | — | — | \| | \| | \| | \| |
| Glass | — | — | — | — | — | — | \| | X | X | X | X |
| China Plate | — | — | — | — | — | \| | \| | \| | X | X | X |
| Mel Plate | — | — | — | — | — | \| | \| | \| | X | X | X |
| P3 Plate | — | — | — | — | — | \| | \| | \| | X | X | X |
| P3 Cup | — | — | — | — | — | — | \| | X | X | X | X |

TABLE 3-continued

Formula 3
Formula 1 with Silwet ® L-77 and no FC-170-C
Soft water, 160° F., Hotpoint Soiled Dishes. (—) no sheeting, (|) pinhole sheeting, (X) complete sheeting.

| Parts Per Million Actives | 0 | 10 | 20 | 30 | 40 | 50 | 60 | 70 | 80 | 90 | 100 |
|---|---|---|---|---|---|---|---|---|---|---|---|
| Dnx Cup | — | — | — | — | — | \| | X | X | X | X | X |
| Dnx Bowl | — | — | — | — | — | \| | X | X | X | X | X |
| P3 Jug | — | — | — | — | — | — | — | \| | \| | \| | \| |
| Poly Try | — | — | — | — | — | \| | \| | X | X | X | X |
| PS (dish) | — | — | — | — | — | — | — | \| | \| | \| | \| |
| PS Spoon | — | — | — | — | — | — | \| | \| | X | X | X |
| SS Knife | — | — | — | — | — | — | \| | \| | X | X | X |
| Temp °F. | 160 | 160 | 160 | 159 | 160 | 160 | 160 | 160 | 160 | 161 | 161 |
| Foam °F. | 0 | 0 | 0 | 0 | 0 | 0.3 | 0.3 | 0.4 | 0.6 | 0.8 | 0.9 |

TABLE 4

Formula 4
Formula 1 with Silwet ® L-77 and FC-170C.
Soft water, 160° F., Hotpoint Soiled Dishes. (—) no sheeting, (|) pinhole sheeting, (X) complete sheeting.

| Parts Per Million Actives | 0 | 10 | 20 | 30 | 40 | 50 | 60 | 70 | 80 | 90 | 100 |
|---|---|---|---|---|---|---|---|---|---|---|---|
| PC Bowl | — | — | — | — | X | X | X | X | X | | |
| PC Tile | — | — | — | — | \| | X | X | X | X | | |
| Glass | — | — | — | \| | X | X | X | X | X | | |
| China Plate | — | \| | \| | \| | X | X | X | X | X | | |
| Mel Plate | — | — | — | \| | X | X | X | X | X | | |
| P3 Plate | — | — | — | \| | \| | \| | X | X | X | | |
| P3 Cup | — | — | \| | \| | X | X | X | X | X | | |
| Dnx Cup | — | — | — | — | X | X | X | X | X | | |
| Dnx Bowl | — | — | — | — | X | X | X | X | X | | |
| P3 Jug | — | — | — | — | \| | \| | \| | \| | \| | | |
| Poly Try | — | — | — | \| | X | X | X | X | X | | |
| PS (dish) | — | — | — | — | \| | X | X | X | X | | |
| PS Spoon | — | — | — | — | \| | X | X | X | X | | |
| SS Knife | — | — | — | \| | X | X | X | X | X | | |
| Temp °F. | 160 | 160 | 160 | 160 | 161 | 161 | 158 | 160 | 161 | | |
| Foam °F. | 0 | 0 | 0 | 0 | 0.1 | 0.2 | 0.4 | 0.3 | 0.2 | | |

The following three solid rinse aid formulations were prepared as previously described and compared side by side. Formula 5 contained the same active ingredients as Formula 4 of Example I. The results (Tables 5, 6 and 7) show similar effectiveness as with the Formula 4 compositions.

| Item | Raw Material | Formula No. (wt-%) 5 | 6 | 7 |
|---|---|---|---|---|
| 1 | EO/PO Block Terminated with PO (32% EO) | 19.649 | 19.649 | 19.649 |
| 2 | EO/PO Block Terminated with PO (39% EO) | 53.248 | 53.248 | 53.248 |
| 3 | Fluorad ™ FC-170C | 0.875 | 0.875 | 0.875 |
| 4 | Silwet ® L-77 | 1.313 | | |
| 5 | ABIL ®-B-8852[a] | | 1.313 | |
| 6 | ABIL ®-B-8863[b] | | | 1.313 |
| 7 | $C_{14-15}$ linear primary alcohol ethoxylate | 5.000 | 5.000 | 5.000 |

-continued

The following three solid rinse aid formulations were prepared as previously described and compared side by side. Formula 5 contained the same active ingredients as Formula 4 of Example I. The results (Tables 5, 6 and 7) show similar effectiveness as with the Formula 4 compositions.

| Item | Raw Material | Formula No. (wt-%) 5 | 6 | 7 |
|---|---|---|---|---|
| 8 | Urea | 16.000 | 16.000 | 16.000 |
| 9 | Inerts to 100% | | | |

[a]A siloxane of the formula described above where Z is H and the EO:PO weight ratio in % is 20:80.

[b]A siloxane of the formula described above where Z is H and the EO:PO weight ratio in % is 40:60.

TABLE 5

| | Formula 5 | | | | | | | | | | | | | | | |
|---|---|---|---|---|---|---|---|---|---|---|---|---|---|---|---|---|
| Parts Per Million | 0 | 10 | 20 | 30 | 40 | 50 | 60 | 70 | 80 | 90 | 100 | 110 | 120 | 130 | 140 | 150 |
| Polycarbonate Tile | — | — | — | — | — | — | — | — | — | — | \| | \| | \| | \| | \| | \| |
| Polycarbonate Bowl | — | — | — | — | — | — | — | \| | \| | \| | \| | \| | \| | \| | \| | \| |
| Glass Tumbler | — | — | — | — | — | \| | \| | \| | \| | \| | \| | \| | \| | \| | \| | \| |
| China Plate | — | — | — | — | — | — | \| | \| | \| | \| | \| | \| | \| | \| | \| | \| |
| Melamine Plate | — | — | — | — | \| | \| | \| | \| | \| | \| | \| | \| | \| | \| | \| | \| |
| Polypropylene Plate | — | — | — | — | — | — | \| | \| | \| | \| | \| | \| | \| | \| | \| | \| |
| Polypropylene Cup | — | — | — | — | — | \| | \| | X | X | X | X | X | X | X | X | X |
| Dinex Cup | — | — | — | — | — | — | \| | X | X | X | X | X | X | X | X | X |
| Dinex Bowl | — | — | — | — | — | \| | \| | X | X | X | X | X | X | X | X | X |
| Polypropylene Jug | — | — | — | — | — | — | \| | \| | \| | \| | \| | \| | \| | \| | \| | \| |
| Poly Tray | — | — | — | — | — | — | \| | X | X | X | X | X | X | X | X | X |
| Polysulfonate Dish | — | — | — | — | — | — | — | \| | \| | \| | \| | \| | \| | \| | \| | \| |
| Polysulfonate Spoon | — | — | — | — | — | — | — | \| | \| | \| | \| | \| | \| | \| | \| | \| |
| Stainless Steel Knife | — | — | — | — | — | — | \| | X | X | X | X | X | X | X | X | X |
| Temperature (F.) | 161 | 161 | 161 | 161 | 160 | 160 | 160 | 160 | 160 | 160 | 160 | 160 | 160 | 160 | 160 | 160 |
| Foam (°F.) | 0 | 0 | 0 | 0 | 0 | 0 | 0 | 0.1 | 0.1 | 0.2 | 0.2 | 0.2 | 0.3 | 0.3 | 0.3 | 0.3 |

TABLE 6

| | Formula 6 | | | | | | | | | | | | | | | |
|---|---|---|---|---|---|---|---|---|---|---|---|---|---|---|---|---|
| Parts Per Million | 0 | 10 | 20 | 30 | 40 | 50 | 60 | 70 | 80 | 90 | 100 | 110 | 120 | 130 | 140 | 150 |
| Polycarbonate Tile | — | — | — | — | — | — | — | — | \| | — | \| | \| | \| | \| | \| | \| |
| Polycarbonate Bowl | — | — | — | — | — | — | — | \| | \| | \| | \| | \| | \| | \| | \| | \| |
| Glass Tumbler | — | — | — | — | — | — | — | \| | \| | \| | \| | \| | \| | \| | \| | \| |
| China Plate | — | — | — | — | — | — | \| | \| | \| | \| | \| | \| | \| | \| | \| | \| |
| Melamine Plate | — | — | — | — | — | — | \| | \| | \| | \| | \| | \| | \| | \| | \| | \| |
| Polypropylene Plate | — | — | — | — | — | \| | \| | \| | \| | \| | \| | \| | \| | \| | \| | \| |
| Polypropylene Cup | — | — | — | — | \| | \| | \| | X | X | X | X | X | X | X | X | X |
| Dinex Cup | — | — | — | — | \| | \| | \| | X | X | X | X | X | X | X | X | X |
| Dinex Bowl | — | — | — | — | \| | \| | \| | X | X | X | X | X | X | X | X | X |
| Polypropylene Jug | — | — | — | — | — | \| | \| | \| | \| | \| | \| | \| | \| | \| | \| | \| |
| Poly Tray | — | — | — | — | — | — | — | \| | \| | X | X | X | X | X | X | X |
| Polysulfonate Dish | — | — | — | — | — | — | \| | \| | \| | \| | \| | \| | \| | \| | \| | \| |
| Polysulfonate Spoon | — | — | — | — | — | — | \| | \| | \| | \| | \| | \| | \| | \| | \| | \| |
| Stainless Steel Knife | — | — | — | — | — | — | \| | \| | \| | \| | \| | \| | \| | X | X | X |
| Temperature (°F.) | 160 | 160 | 160 | 160 | 160 | 160 | 160 | 160 | 160 | 160 | 160 | 160 | 160 | i6D | 160 | 160 |
| Foam (°F.) | 0 | 0 | 0 | 0 | 0 | 0 | 0 | 0 | 0.1 | 0.1 | 0.1 | 0.2 | 0.2 | 0.2 | 0.3 | 0.3 |

TABLE 7

| | Formula 7 | | | | | | | | | | | | | | | |
|---|---|---|---|---|---|---|---|---|---|---|---|---|---|---|---|---|
| Parts Per Million | 0 | 10 | 20 | 30 | 40 | 50 | 60 | 70 | 80 | 90 | 100 | 110 | 120 | 130 | 140 | 150 |
| Polycarbonate Tile | — | — | — | — | — | — | \| | \| | \| | \| | \| | \| | \| | \| | \| | \| |
| Polycarbonate Bowl | — | — | — | — | — | — | \| | \| | \| | \| | \| | \| | \| | \| | \| | \| |
| Glass Tumbler | — | — | — | — | — | — | \| | \| | \| | \| | \| | \| | \| | \| | \| | \| |
| China Plate | — | — | — | — | — | — | \| | \| | \| | \| | \| | \| | \| | \| | \| | \| |
| Melamine Plate | — | — | — | — | — | \| | \| | \| | \| | \| | \| | \| | \| | \| | \| | \| |
| Polypropylene Plate | — | — | — | — | — | \| | \| | \| | \| | \| | \| | \| | \| | \| | \| | \| |
| Polypropylene Cup | — | — | — | — | \| | \| | \| | X | X | X | X | X | X | X | X | X |
| Dinex Cup | — | — | — | — | \| | \| | \| | X | X | X | X | X | X | X | X | X |
| Dinex Bowl | — | — | — | — | \| | \| | \| | X | X | X | X | X | X | X | X | X |
| Polypropylene Jug | — | — | — | — | — | \| | \| | \| | \| | \| | \| | \| | \| | \| | \| | \| |
| Poly Tray | — | — | — | — | — | — | \| | \| | X | X | X | X | X | X | X | X |
| Polysulfonate Dish | — | — | — | — | — | — | \| | \| | \| | \| | \| | \| | \| | \| | \| | \| |

TABLE 7-continued

| | Formula 7 | | | | | | | | | | | | | | | |
|---|---|---|---|---|---|---|---|---|---|---|---|---|---|---|---|---|
| Parts Per Million | 0 | 10 | 20 | 30 | 40 | 50 | 60 | 70 | 80 | 90 | 100 | 110 | 120 | 130 | 140 | 150 |
| Polysulfonate Spoon | — | — | — | — | — | — | \| | \| | \| | \| | \| | \| | \| | \| | \| | \| |
| Stainless Steel Knife | — | — | — | — | — | — | \| | \| | \| | \| | \| | \| | \| | X | X | X |
| Temperature (F.) | 160 | 160 | 160 | 160 | 160 | 160 | 160 | 160 | 160 | 160 | 160 | 160 | 160 | 160 | 160 | 160 |
| Foam (") | 0 | 0 | 0 | 0 | 0 | 0 | 0 | 0 | 0 | 0 | 0 | 0 | 0 | 0 | 0 | 0 |

EXAMPLE III

The following formulations were made and evaluated. All additives are used at the same concentration of actives.

| | | FORMULA No. (PERCENT) | | | | |
|---|---|---|---|---|---|---|
| Item | Raw Material | 8 | 9 | 10 | 11 | 12 |
| 1 | EO/PO Block Terminated With PO (32% PO) | 19.300 | 19.868 | 19.884 | 19.885 | 19.885 |
| 2 | EO/PO Block Terminated With PO (39% EO) | 52.300 | 53.841 | 53.887 | 53.887 | 53.887 |
| 3 | ABIL B9950 | — | 4.376 | — | — | — |
| 4 | ABIL - Quat 3272 | — | — | 2.628 | — | — |
| 5 | ABIL - B-8878 | — | — | — | 1.313 | — |
| 6 | ABIL - B-8847 | — | — | — | — | 1.313 |
| 7 | Inerts to 100% | | | | | |

| | | 13 | 14 | 15 | 16 | 17 |
|---|---|---|---|---|---|---|
| 1 | EO/PO Block Terminated With PO (39% EO) | 19.885 | 19.885 | 19.884 | 19.884 | 19.884 |
| 2 | EO/PO Block Terminated With PO (39% EO) | 53.887 | 53.887 | 53.887 | 53.887 | 53.887 |
| 3 | ABIL-8842 | 1.313 | — | — | — | |
| 4 | Tegopren-5840 | — | 1.313 | — | — | |
| 5 | PECOSIL SMQ-40 | — | — | 3.284 | — | |
| 6 | PECOSIL SBP-1240 | — | — | — | 3.284 | |
| 7 | PECOSIL CAP-1240 | — | — | — | — | 3.284 |
| 8 | Inerts to 100% | | | | | |

ABIL QUAT 3272 is available from Goldschmidt Chemical and is a copolymer of polydimethyl siloxane and an organic quaternary nitrogen groups. It is 50% active.

ABIL B9550 is available from Goldschmidt Chemical and is a polysiloxane polyorganobetaine copolymer of the formula described above where R is $-(CH_2)_3-O-CH_2CH(OH)CH_2-\underset{\underset{CH_3}{|}}{\overset{\overset{CH_3}{|}}{N^+}}-CH_2COO^-$;

m = 4–7 and m + n = about 16–21 where the ratio of n/m is about 2.5–3.5; m.wt. between 2,000 and 3,000

ABIL B-8847 A silicone of the formula described above where Z is H and the EO:PO wt. ratio is 80:20 mwt. @ 800.

B-8842 A silicone of the formula described above where Z is H and the EO:PO wt. ratio is 100:0 mwt. @ 500.

B-8878 A silicone of the formula described above where Z is H and the EO:PO wt. ratio is 100:0 mwt. @ 600.

Tegopren 5840 Polyether polysiloxane

PECOSIL SPB-1240 and SMQ-40 and CAP-1240 are available from Phoenix Chemical and are Silicone Phosphobetaines. These are 40% active.

These formulations were evaluated in a modified Champion 1 KAB dishwash machine as described in Example I. Results are given below in table form for each of the ten formulations noted above.

Tables 8–17

Table 8 contains results for a commercially available rinse aid. Note that none of the plastic substrates exhibit complete sheeting until 70 ppm actives are used. This is that standard formulation that the next nine are compared to.

Table 9 contains results for the same set of actives containing ABIL B-9950. It performs much better at 40 ppm to complete sheet on some of the plastic substrates. This formulation represents the invention.

Table 10 contains results for the same set of actives containing ABIL-Quat 3272. It performs marginally worse at 80 ppm to complete sheet on some of the plastic substrates.

Table 11 contains results for the same set of actives containing ABIL-B-8878. It performs marginally better at 60 ppm to complete sheet on some of the plastic substrates.

Table 12 contains results for the same set of actives containing ABIL-B-8847. It performs marginally better at 60 ppm to complete sheet on some of the plastic substrates.

Table 13 contains results for the same set of actives containing ABIL-B-8842. It performs at 50 ppm to complete sheet on some of the plastic substrates.

This is a second embodiment of the invention.

Table 14 contains results for the same set of actives containing Tegopren-5840. It performs much worse with no complete sheeting on any plastic substrates up to 150 ppm.

Table 15 contains results for the same set of actives containing PECOSIL SMQ-40. It performs much worse with no complete sheeting on any plastic substrates up to 150 ppm.

Table 16 contains results for the same set of actives containing PECOSIL SPB-1240. It performs radically worse with no sheeting on any substrates up to 150 ppm.

Table 17 contains results for the same set of actives containing PECOSIL CAP-1240. It performs marginally worse at 90 ppm to complete sheet on some of the plastic substrates.

The nature of the silicone additive can radically affect results. Some additives provide much better results when added to the basic set of rinse aid ingredients, some do not affect results much, and some detract from results.

The invention represented as Formulation 9 was also evaluated in eight institutional test accounts relative to the commercially available rinse aid represented as Formulation 1. In each account at either the same or even at a lower concentration, there has been a significant improvement in drying results on plasticware. With the commercially available product large residual droplets of rinse water remained on the plasticware so that the dry time was much too long. With the invention either there were very small residual droplets of rinse water or the rinse water sheeted from the plasticware. The dry time was greatly reduced and results were judged as acceptable.

TABLE 8

| Parts Per Million | 0 | 10 | 20 | 30 | 40 | 50 | 60 | 70 | 80 | 90 | 100 | 110 | 120 | 130 | 140 | 150 | 175 | 200 | 225 |
|---|---|---|---|---|---|---|---|---|---|---|---|---|---|---|---|---|---|---|---|
| Polycarbonate Tile | 0 | 0 | 0 | 0 | 0 | 0 | 1 | 2 | 2 | 2 | 2 | 2 | 2 | 2 | 2 | 2 | | | |
| Polycarbonate Bowl | 0 | 0 | 0 | 0 | 0 | 0 | 1 | 1 | 2 | 2 | 2 | 2 | 2 | 2 | 2 | 2 | | | |
| Glass Tumbler | 0 | 0 | 0 | 0 | 1 | 1 | 1 | 2 | 2 | 2 | 2 | 2 | 2 | 2 | 2 | 2 | | | |
| China Plate | 0 | 0 | 0 | 0 | 0 | 1 | 1 | 1 | 1 | 1 | 1 | 2 | 2 | 2 | 2 | 2 | | | |
| Melamine Plate | 0 | 0 | 0 | 0 | 0 | 1 | 1 | 1 | 1 | 2 | 2 | 2 | 2 | 2 | 2 | 2 | | | |
| Polypropylene Plate | 0 | 0 | 0 | 0 | 0 | 1 | 1 | 1 | 1 | 2 | 2 | 2 | 2 | 2 | 2 | 2 | | | |
| Polypropylene Cup | 0 | 0 | 0 | 0 | 1 | 1 | 1 | 1 | 1 | 2 | 2 | 2 | 2 | 2 | 2 | 2 | | | |
| Dinex Cup | 0 | 0 | 0 | 0 | 0 | 1 | 1 | 1 | 1 | 2 | 2 | 2 | 2 | 2 | 2 | 2 | | | |
| Dinex Bowl | 0 | 0 | 0 | 0 | 0 | 1 | 1 | 1 | 1 | 2 | 2 | 2 | 2 | 2 | 2 | 2 | | | |
| Polypropylene Jug | 0 | 0 | 0 | 0 | 0 | 1 | 1 | 1 | 1 | 1 | 1 | 1 | 1 | i | 1 | 1 | | | |
| Poly Tray | 0 | 0 | 0 | 0 | 1 | 1 | 1 | 1 | 1 | 2 | 2 | 2 | 2 | 2 | 2 | 2 | | | |
| Polysulfonate Dish | 0 | 0 | 0 | 0 | 0 | 0 | 1 | 1 | 1 | 2 | 2 | 2 | 2 | 2 | 2 | 2 | | | |
| Polysulfonate Spoon | 0 | 0 | 0 | 0 | 0 | 0 | 1 | 1 | 1 | 1 | 2 | 2 | 2 | 2 | 2 | 2 | | | |
| Stainless Steel Knife | 0 | 0 | 0 | 0 | 0 | 1 | 1 | 1 | 1 | 2 | 2 | 2 | 2 | 2 | 2 | 2 | | | |
| Temperature (°F.) | 160 | 160 | 160 | 160 | 160 | 160 | 160 | 160 | 160 | 160 | 160 | 160 | 160 | 160 | 160 | 160 | | | |

TABLE 9

| Parts Per Million | 0 | 10 | 20 | 30 | 40 | 50 | 60 | 70 | 80 | 90 | 100 | 110 | 120 | 130 | 140 | 150 | 175 | 200 | 225 |
|---|---|---|---|---|---|---|---|---|---|---|---|---|---|---|---|---|---|---|---|
| Polycarbonate Tile | 0 | 0 | 0 | 0 | 1 | 1 | 1 | 2 | 2 | 2 | 2 | 2 | 2 | 2 | 2 | 2 | | | |
| Polycarbonate Bowl | 0 | 0 | 0 | 0 | 1 | 1 | 1 | 2 | 2 | 2 | 2 | 2 | 2 | 2 | 2 | 2 | | | |
| Glass Tumbler | 0 | 0 | 0 | 0 | 0 | 1 | 1 | 2 | 2 | 2 | 2 | 2 | 2 | 2 | 2 | 2 | | | |
| China Plate | 0 | 0 | 0 | 1 | 1 | 1 | 1 | 2 | 2 | 2 | 2 | 2 | 2 | 2 | 2 | 2 | | | |
| Melamine Plate | 0 | 0 | 0 | 1 | 1 | 1 | 1 | 1 | 1 | 1 | 1 | 1 | 1 | 1 | 1 | 1 | | | |
| Polypropylene Plate | 0 | 0 | 0 | 1 | 1 | 1 | 1 | 1 | 2 | 2 | 2 | 2 | 2 | 2 | 2 | 2 | | | |

TABLE 9-continued

| Parts Per Million | 0 | 10 | 20 | 30 | 40 | 50 | 60 | 70 | 80 | 90 | 100 | 110 | 120 | 130 | 140 | 150 | 175 | 200 | 225 |
|---|---|---|---|---|---|---|---|---|---|---|---|---|---|---|---|---|---|---|---|
| Polypropylene Cup | 0 | 0 | 0 | 1 | 2 | 2 | 2 | 2 | 2 | 2 | 2 | 2 | 2 | 2 | 2 | 2 | | | |
| Dinex Cup | 0 | 0 | 0 | 1 | 2 | 2 | 2 | 2 | 2 | 2 | 2 | 2 | 2 | 2 | 2 | 2 | | | |
| Dinex Bowl | 0 | 0 | 0 | 1 | 2 | 2 | 2 | 2 | 2 | 2 | 2 | 2 | 2 | 2 | 2 | 2 | | | |
| Polypropylene Jug | 0 | 0 | 0 | 1 | 1 | 2 | 2 | 2 | 2 | 2 | 2 | 2 | 2 | 2 | 2 | 2 | | | |
| Poly Tray | 0 | 0 | 0 | 1 | 1 | 2 | 2 | 2 | 2 | 2 | 2 | 2 | 2 | 2 | 2 | 2 | | | |
| Polysulfonate Dish | 0 | 0 | 0 | 0 | 0 | 1 | 1 | 2 | 2 | 2 | 2 | 2 | 2 | 2 | 2 | 2 | | | |
| Polysulfonate Spoon | 0 | 0 | 0 | 0 | 0 | 1 | 1 | 2 | 2 | 2 | 2 | 2 | 2 | 2 | 2 | 2 | | | |
| Stainless Steel Knife | 0 | 0 | 0 | 0 | 1 | 1 | 1 | 2 | 2 | 2 | 2 | 2 | 2 | 2 | 2 | 2 | | | |
| Temperature (°F.) | 160 | 160 | 160 | 160 | 160 | 160 | 160 | 160 | 160 | 160 | 160 | 160 | 160 | 160 | 160 | 160 | | | |

TABLE 10

| Parts Per Million | 0 | 10 | 20 | 30 | 40 | 50 | 60 | 70 | 80 | 90 | 100 | 110 | 120 | 130 | 140 | 150 | 175 | 200 | 225 |
|---|---|---|---|---|---|---|---|---|---|---|---|---|---|---|---|---|---|---|---|
| Polycarbonate Tile | 0 | 0 | 0 | 0 | 0 | 0 | 0 | 0 | 0 | 1 | 1 | 1 | 1 | 1 | 1 | 1 | | | |
| Polycarbonate Bowl | 0 | 0 | 0 | 0 | 0 | 0 | 0 | 0 | 1 | 1 | 1 | 1 | 1 | 1 | 1 | 1 | | | |
| Glass Tumbler | 0 | 0 | 0 | 0 | 0 | 0 | 0 | 0 | 0 | 1 | 1 | 1 | 1 | 1 | 1 | 1 | | | |
| China Plate | 0 | 0 | 0 | 0 | 0 | 0 | 0 | 1 | 1 | 1 | 1 | 1 | 1 | 1 | 1 | 1 | | | |
| Melamine Plate | 0 | 0 | 0 | 0 | 0 | 1 | 1 | 1 | 1 | 1 | 1 | 1 | 1 | 1 | 1 | 1 | | | |
| Polypropylene Plate | 0 | 0 | 0 | 0 | 0 | 0 | 1 | 1 | 1 | 1 | 1 | 1 | 1 | 1 | 1 | 1 | | | |
| Polypropylene Cup | 0 | 0 | 0 | 1 | 1 | 1 | 1 | 1 | 1 | 1 | 1 | 2 | 2 | 2 | 2 | 2 | | | |
| Dinex Cup | 0 | 0 | 0 | 0 | 0 | 0 | 1 | 1 | 1 | 1 | 1 | 2 | 2 | 2 | 2 | 2 | | | |
| Dinex Bowl | 0 | 0 | 0 | 0 | 0 | 0 | 1 | 1 | 1 | 2 | 2 | 2 | 2 | 2 | 2 | 2 | | | |
| Polypropylene Jug | 0 | 0 | 0 | 0 | 0 | 0 | 1 | 1 | 1 | 1 | 1 | 1 | 1 | 1 | 1 | 1 | | | |
| Poly Tray | 0 | 0 | 0 | 1 | 1 | 1 | 1 | 1 | 2 | 2 | 2 | 2 | 2 | 2 | 2 | 2 | | | |
| Polysulfonate Dish | 0 | 0 | 0 | 0 | 0 | 0 | 0 | 0 | 0 | 1 | 1 | 1 | 1 | 1 | 1 | 1 | | | |
| Polysulfonate Spoon | 0 | 0 | 0 | 0 | 0 | 0 | 0 | 0 | 0 | 1 | 1 | 1 | 1 | 1 | 1 | 1 | | | |
| Stainless Steel Knife | 0 | 0 | 0 | 0 | 0 | 0 | 0 | 0 | 1 | 1 | 1 | 1 | 1 | 1 | 1 | 1 | | | |
| Temperature (°F.) | 160 | 160 | 160 | 160 | 160 | 160 | 160 | 160 | 160 | 160 | 160 | 160 | 160 | 160 | 160 | 160 | | | |

TABLE 11

| Parts Per Million | 0 | 10 | 20 | 30 | 40 | 50 | 60 | 70 | 80 | 90 | 100 | 110 | 120 | 130 | 140 | 150 | 175 | 200 | 225 |
|---|---|---|---|---|---|---|---|---|---|---|---|---|---|---|---|---|---|---|---|
| Polycarbonate Tile | 0 | 0 | 0 | 0 | 0 | 0 | 1 | 1 | 1 | 2 | 2 | 2 | 2 | 2 | 2 | 2 | | | |
| Polycarbonate | 0 | 0 | 0 | 0 | 0 | 0 | 1 | 1 | 1 | 1 | 1 | 1 | 1 | 1 | 1 | 1 | | | |

TABLE 11-continued

| Parts Per Million | 0 | 10 | 20 | 30 | 40 | 50 | 60 | 70 | 80 | 90 | 100 | 110 | 120 | 130 | 140 | 150 | 175 | 200 | 225 |
|---|---|---|---|---|---|---|---|---|---|---|---|---|---|---|---|---|---|---|---|
| Bowl | | | | | | | | | | | | | | | | | | | |
| Glass Tumbler | 0 | 0 | 0 | 0 | 0 | 0 | 1 | 1 | 1 | 1 | 2 | 2 | 2 | 2 | 2 | 2 | | | |
| China Plate | 0 | 0 | 0 | a | 0 | 1 | 1 | 1 | 1 | 2 | 2 | 2 | 2 | 2 | 2 | 2 | | | |
| Melamine Plate | 0 | 0 | 0 | 0 | 0 | 1 | 1 | 1 | 1 | 2 | 2 | 2 | 2 | 2 | 2 | 2 | | | |
| Poly-propylene Plate | 0 | 0 | 0 | 0 | 0 | 1 | 1 | 1 | 1 | 1 | 1 | 1 | 1 | 1 | 1 | 1 | | | |
| Poly-propylene Cup | 0 | 0 | 0 | 1 | 1 | 1 | 1 | 2 | 2 | 2 | 2 | 2 | 2 | 2 | 2 | 2 | | | |
| Dinex Cup | 0 | 0 | 0 | 0 | 1 | 1 | 1 | 2 | 2 | 2 | 2 | 2 | 2 | 2 | 2 | 2 | | | |
| Dinex Bowl | 0 | 0 | 0 | 0 | 1 | 1 | 1 | 2 | 2 | 2 | 2 | 2 | 2 | 2 | 2 | 2 | | | |
| Poly-propylene Jug | 0 | 0 | 0 | 0 | 1 | 1 | 1 | 1 | 1 | 1 | 1 | 1 | 1 | 1 | 1 | 1 | | | |
| Poly Tray | 0 | 0 | 0 | 1 | 1 | 1 | 2 | 2 | 2 | 2 | 2 | 2 | 2 | 2 | 2 | 2 | | | |
| Poly-sulfonate Dish | 0 | 0 | 0 | 0 | 0 | 0 | 0 | 1 | 1 | 1 | 1 | 1 | 1 | 1 | 1 | 1 | | | |
| Poly-sulfonate Spoon | 0 | 0 | 0 | 0 | 0 | 0 | 0 | 1 | 1 | 1 | 1 | 1 | 1 | 1 | 1 | 1 | | | |
| Stainless Steel Knife | 0 | 0 | 0 | 0 | 0 | 0 | 1 | 2 | 2 | 2 | 2 | 2 | 2 | 2 | 2 | 2 | | | |
| Temperature (°F.) | 160 | 160 | 160 | 160 | 160 | 160 | 160 | 160 | 160 | 160 | 160 | 160 | 160 | 160 | 160 | 160 | | | |

TABLE 12

| Parts Per Million | 0 | 10 | 20 | 30 | 40 | 50 | 60 | 70 | 80 | 90 | 100 | 110 | 120 | 130 | 140 | 150 | 175 | 200 | 225 |
|---|---|---|---|---|---|---|---|---|---|---|---|---|---|---|---|---|---|---|---|
| Poly-carbonate Tile | 0 | 0 | 0 | 0 | 0 | 1 | 1 | 2 | 2 | 2 | 2 | 2 | 2 | 2 | 2 | 2 | | | |
| Poly-carbonate Bowl | 0 | 0 | 0 | 0 | 0 | 1 | 1 | 1 | 2 | 2 | 2 | 2 | 2 | 2 | 2 | 2 | | | |
| Glass Tumbler | 0 | 0 | 0 | 0 | 0 | 1 | 1 | 1 | 1 | 1 | 2 | 2 | 2 | 2 | 2 | 2 | | | |
| China Plate | 0 | 0 | 0 | 0 | 0 | 0 | 1 | 2 | 2 | 2 | 2 | 2 | 2 | 2 | 2 | 2 | | | |
| Melamine Plate | 0 | 0 | 0 | 0 | 1 | 1 | 1 | 1 | 2 | 2 | 2 | 2 | 2 | 2 | 2 | 2 | | | |
| Poly-propylene Plate | 0 | 0 | 0 | 0 | 1 | 1 | 1 | 1 | 2 | 2 | 2 | 2 | 2 | 2 | 2 | 2 | | | |
| Poly-propylene Cup | 0 | 0 | 0 | 1 | 1 | 1 | 2 | 2 | 2 | 2 | 2 | 2 | 2 | 2 | 2 | 2 | | | |
| Dinex Cup | 0 | 0 | 0 | 0 | 1 | 1 | 2 | 2 | 2 | 2 | 2 | 2 | 2 | 2 | 2 | 2 | | | |
| Dinex Bowl | 0 | 0 | 0 | 0 | 1 | 1 | 2 | 2 | 2 | 2 | 2 | 2 | 2 | 2 | 2 | 2 | | | |
| Poly-propylene Jug | 0 | 0 | 0 | 0 | 0 | 0 | 1 | 1 | 1 | 1 | 2 | 2 | 2 | 2 | 2 | 2 | | | |
| Poly Tray | 0 | 0 | 0 | 1 | 1 | 1 | 2 | 2 | 2 | 2 | 2 | 2 | 2 | 2 | 2 | 2 | | | |
| Poly-sulfonate Dish | 0 | 0 | 0 | 0 | 0 | 1 | 1 | 1 | 2 | 2 | 2 | 2 | 2 | 2 | 2 | 2 | | | |
| Poly-sulfonate Spoon | 0 | 0 | 0 | 0 | 0 | 0 | 0 | 1 | 1 | 1 | 1 | 1 | 1 | 1 | 1 | 1 | | | |
| Stainless Steel Knife | 0 | 0 | 0 | 0 | 0 | 1 | 2 | 2 | 2 | 2 | 2 | 2 | 2 | 2 | 2 | 2 | | | |
| Temperature (°F.) | 160 | 160 | 160 | 160 | 160 | 160 | 160 | 160 | 160 | 160 | 160 | 160 | 160 | 160 | 160 | 160 | | | |

TABLE 13

| Parts Per Million | 0 | 10 | 20 | 30 | 40 | 50 | E0 | 70 | 80 | 90 | 100 | 110 | 120 | 130 | 140 | 150 | 175 | 200 | 225 |
|---|---|---|---|---|---|---|---|---|---|---|---|---|---|---|---|---|---|---|---|
| Poly-carbonate Tile | 0 | 0 | 0 | 0 | 0 | 1 | 1 | 2 | 2 | 2 | 2 | 2 | 2 | 2 | 2 | 2 | | | |
| Poly-carbonate Bowl | 0 | 0 | 0 | 0 | 0 | 0 | 1 | 1 | 1 | 2 | 2 | 2 | 2 | 2 | 2 | 2 | | | |
| Glass Tumbler | 0 | 0 | 0 | 0 | 0 | 0 | 1 | 1 | 1 | 2 | 2 | 2 | 2 | 2 | 2 | 2 | | | |
| China Plate | 0 | 0 | 0 | 0 | 0 | 0 | 0 | 1 | 1 | 1 | 1 | 1 | 1 | 1 | 1 | 1 | | | |
| Melamine Plate | 0 | 0 | 0 | 0 | 0 | 1 | 1 | 1 | 2 | 2 | 2 | 2 | 2 | 2 | 2 | 2 | | | |
| Poly-propylene Plate | 0 | 0 | 0 | 0 | 1 | 1 | 1 | 2 | 2 | 2 | 2 | 2 | 2 | 2 | 2 | 2 | | | |
| Poly-propylene Cup | 0 | 0 | 0 | 1 | 1 | 1 | 2 | 2 | 2 | 2 | 2 | 2 | 2 | 2 | 2 | 2 | | | |
| Dinex Cup | 0 | 0 | 0 | 0 | 1 | 1 | 2 | 2 | 2 | 2 | 2 | 2 | 2 | 2 | 2 | 2 | | | |
| Dinex Bowl | | | | | | | | | | | | | | | | | | | |
| Poly-propylene Jug | 0 | 0 | 0 | 0 | 1 | 1 | 1 | 1 | 1 | 1 | 1 | 1 | 1 | 1 | 2 | 2 | | | |
| Poly Tray | 0 | 0 | 0 | 1 | 1 | 2 | 2 | 2 | 2 | 2 | 2 | 2 | 2 | 2 | 2 | 2 | | | |
| Poly-sulfonate Dish | 0 | 0 | 0 | 0 | 0 | 0 | 0 | 1 | 1 | 1 | 1 | 1 | 1 | 2 | 2 | 2 | | | |
| Poly-sulfonate Spoon | 0 | 0 | 0 | 0 | 0 | 0 | 0 | 0 | 0 | 1 | 1 | 1 | 1 | 1 | 1 | 1 | | | |
| Stainless Steel Knife | 0 | 0 | 0 | 0 | 0 | 1 | 1 | 2 | 2 | 2 | 2 | 2 | 2 | 2 | 2 | 2 | | | |
| Temperature (°F.) | 160 | 160 | 160 | 160 | 160 | 160 | 160 | 160 | 160 | 160 | 160 | 160 | 160 | 160 | 160 | 160 | | | |

TABLE 14

| Parts Per Million | 0 | 10 | 20 | 30 | 40 | 50 | 60 | 70 | 80 | 90 | 100 | 110 | 120 | 130 | 140 | 150 | 175 | 200 | 225 |
|---|---|---|---|---|---|---|---|---|---|---|---|---|---|---|---|---|---|---|---|
| Poly-carbonate Tile | 0 | 0 | 0 | 0 | 0 | 0 | 1 | 1 | 1 | 1 | 1 | 1 | 1 | 1 | 1 | 1 | | | |
| Poly-carbonate Bowl | 0 | 0 | 0 | 0 | 0 | 0 | 1 | 1 | 1 | 1 | 1 | 1 | 1 | 1 | 1 | 1 | | | |
| Glass Tumbler | 0 | 0 | 0 | 0 | 0 | 1 | 1 | 1 | 1 | 1 | 1 | 1 | 1 | 1 | 1 | 1 | | | |
| China Plate | 0 | 0 | 0 | 0 | 0 | 1 | 1 | 1 | 1 | 1 | 1 | 1 | 1 | 1 | 1 | 1 | | | |
| Melamine Plate | 0 | 0 | 0 | 0 | 0 | 1 | 1 | 1 | 1 | 1 | 1 | 1 | 1 | 1 | 1 | 1 | | | |
| Poly-propylene Plate | 0 | 0 | 0 | 0 | 0 | 0 | 1 | 1 | 1 | 1 | 1 | 1 | 1 | 1 | 1 | 1 | | | |
| Poly-propylene Cup | 0 | 0 | 0 | 0 | 0 | 0 | 1 | 1 | 1 | 1 | 1 | 1 | 1 | 1 | 1 | 1 | | | |
| Dinex Cup | 0 | 0 | 0 | 0 | 0 | 0 | 1 | 1 | 1 | 1 | 1 | 1 | 1 | 1 | 1 | 1 | | | |
| Dinex Bowl | 0 | 0 | 0 | 0 | 0 | 0 | 1 | 1 | 1 | 1 | 1 | 1 | 1 | 1 | 1 | 1 | | | |
| Poly-propylene Jug | 0 | 0 | 0 | 0 | 0 | 0 | 1 | 1 | 1 | 1 | 1 | 1 | 1 | 1 | 1 | 1 | | | |
| Poly Tray | 0 | 0 | 0 | 0 | 0 | 0 | 1 | 1 | 1 | 1 | 1 | 1 | 1 | 1 | 1 | 1 | | | |
| Poly-sulfonate Dish | 0 | 0 | 0 | 0 | 0 | 0 | 0 | 0 | 0 | 0 | 1 | 1 | 1 | 1 | 1 | 1 | | | |
| Poly-sulfonate Spoon | 0 | 0 | 0 | 0 | 0 | 0 | 0 | 0 | 0 | 0 | 0 | 1 | 1 | 1 | 1 | 1 | | | |
| Stainless | 0 | 0 | 0 | 0 | 0 | 0 | 1 | 1 | 1 | 2 | 2 | 1 | 1 | 1 | 1 | 1 | | | |

TABLE 14-continued

| Parts Per Million | 0 | 10 | 20 | 30 | 40 | 50 | 60 | 70 | 80 | 90 | 100 | 110 | 120 | 130 | 140 | 150 | 175 | 200 | 225 |
|---|---|---|---|---|---|---|---|---|---|---|---|---|---|---|---|---|---|---|---|
| Steel Knife Temperature (°F.) | 160 | 160 | 160 | 160 | 160 | 160 | 160 | 160 | 160 | 160 | 160 | 160 | 160 | 160 | 160 | 160 | | | |

TABLE 15

| Parts Per Million | 0 | 10 | 20 | 30 | 40 | 50 | 60 | 70 | 80 | 90 | 100 | 110 | 120 | 130 | 140 | 150 | 175 | 200 | 225 |
|---|---|---|---|---|---|---|---|---|---|---|---|---|---|---|---|---|---|---|---|
| Poly-carbonate Tile | 0 | 0 | 0 | 0 | 0 | 0 | 0 | 0 | 1 | 1 | 1 | 1 | 1 | 1 | 1 | 1 | | | |
| Poly-carbonate Bowl | 0 | 0 | 0 | 0 | 0 | 0 | 0 | 0 | 0 | 1 | 1 | 1 | 1 | 1 | 1 | I | | | |
| Glass Tumbler | 0 | 0 | 0 | 0 | 0 | 0 | 0 | 1 | 1 | 1 | 1 | 1 | 1 | 1 | 1 | 1 | | | |
| China Plate | 0 | 0 | 0 | 0 | 0 | 1 | 1 | 1 | 1 | 1 | 1 | 1 | 1 | 1 | 1 | 1 | | | |
| Melamine Plate | 0 | 0 | 0 | 0 | 0 | 0 | 0 | 1 | 1 | 1 | 1 | 1 | 1 | 1 | 1 | 1 | | | |
| Poly-propylene Plate | 0 | 0 | 0 | 0 | 0 | 1 | 1 | 1 | 1 | 1 | 1 | 1 | 1 | 1 | 1 | 1 | | | |
| Poly-propylene Cup | 0 | 0 | 0 | 0 | 0 | 0 | 0 | 0 | 1 | 1 | 1 | 1 | 1 | 1 | 1 | 1 | | | |
| Dinex Cup | 0 | 0 | 0 | 0 | 0 | 0 | 0 | 0 | 1 | 1 | 1 | 1 | 1 | 1 | 1 | 1 | | | |
| Dinex Bowl | 0 | 0 | 0 | 0 | 0 | 0 | 0 | 0 | 1 | 1 | 1 | 1 | 1 | 1 | 1 | 1 | | | |
| Poly-propylene Jug | 0 | 0 | 0 | 0 | 0 | 0 | 0 | 0 | 0 | 1 | 1 | 1 | 1 | 1 | 1 | 1 | | | |
| Poly Tray | 0 | 0 | 0 | 0 | 0 | 1 | 1 | 1 | 1 | 1 | 1 | 1 | 1 | 1 | 1 | 1 | | | |
| Poly-sulfonate Dish | 0 | 0 | 0 | 0 | 0 | 0 | 0 | 0 | 0 | 0 | 0 | 0 | 1 | 1 | 1 | 1 | | | |
| Poly-sulfonate Spoon | 0 | 0 | 0 | 0 | 0 | 0 | 0 | 0 | 0 | 0 | 0 | 0 | 1 | 1 | 1 | 1 | | | |
| Stainless Steel Knife | 0 | 0 | 0 | 0 | 0 | 0 | 0 | 0 | 1 | 1 | 1 | 1 | 1 | 1 | 1 | 1 | | | |
| Temperature (°F.) | 160 | 160 | 160 | 160 | 160 | 160 | 160 | 160 | 160 | 160 | 160 | 160 | 160 | 160 | 160 | 160 | | | |

TABLE 16

| Parts Per Million | 0 | 10 | 20 | 30 | 40 | 50 | 60 | 70 | 80 | 90 | 100 | 110 | 120 | 130 | 140 | 150 | 175 | 200 | 225 |
|---|---|---|---|---|---|---|---|---|---|---|---|---|---|---|---|---|---|---|---|
| Poly-carbonate Tile | 0 | 0 | 0 | 0 | 0 | 0 | 0 | 0 | 0 | 0 | 0 | 0 | 0 | 0 | 0 | 0 | | | |
| Poly-carbonate Bowl | 0 | 0 | 0 | 0 | 0 | 0 | 0 | 0 | 0 | 0 | 0 | 0 | 0 | 0 | 0 | 0 | | | |
| Glass Tumbler | 0 | 0 | 0 | 0 | 0 | 0 | 0 | 0 | 0 | 0 | 0 | 0 | 0 | 0 | 0 | 0 | | | |
| China Plate | 0 | 0 | 0 | 0 | 0 | 0 | 0 | 0 | 0 | 0 | 0 | 0 | 0 | 0 | 0 | 0 | | | |
| Melamine Plate | 0 | 0 | 0 | 0 | 0 | 0 | 0 | 0 | 0 | 0 | 0 | 0 | 0 | 0 | 0 | 0 | | | |
| Poly-propylene Plate | 0 | 0 | 0 | 0 | 0 | 0 | 0 | 0 | 0 | 0 | 0 | 0 | 0 | 0 | 0 | 0 | | | |
| Poly-propylene Cup | 0 | 0 | 0 | 0 | 0 | 0 | 0 | 0 | 0 | 0 | 0 | 0 | 0 | 0 | 0 | 0 | | | |
| Dinex Cup | 0 | 0 | 0 | 0 | 0 | 0 | 0 | 0 | 0 | 0 | 0 | 0 | 0 | 0 | 0 | 0 | | | |
| Dinex Bowl | 0 | 0 | 0 | 0 | 0 | 0 | 0 | 0 | 0 | 0 | 0 | 0 | 0 | 0 | 0 | 0 | | | |
| Poly-propylene | 0 | 0 | 0 | 0 | 0 | 0 | 0 | 0 | 0 | 0 | 0 | 0 | 0 | 0 | 0 | 0 | | | |

TABLE 16-continued

| Parts Per Million | 0 | 10 | 20 | 30 | 40 | 50 | 60 | 70 | 80 | 90 | 100 | 110 | 120 | 130 | 140 | 150 | 175 | 200 | 225 |
|---|---|---|---|---|---|---|---|---|---|---|---|---|---|---|---|---|---|---|---|
| Jug | | | | | | | | | | | | | | | | | | | |
| Poly Tray | 0 | 0 | 0 | 0 | 0 | 0 | 0 | 0 | 0 | 0 | 0 | 0 | 0 | 0 | 0 | 0 | | | |
| Poly-sulfonate Dish | 0 | 0 | 0 | 0 | 0 | 0 | 0 | 0 | 0 | 0 | 0 | 0 | 0 | 0 | 0 | 0 | | | |
| Poly-sulfonate Spoon | 0 | 0 | 0 | 0 | 0 | 0 | 0 | 0 | 0 | 0 | 0 | 0 | 0 | 0 | 0 | 0 | | | |
| Stainless Steel Knife | 0 | 0 | 0 | 0 | 0 | 0 | 0 | 0 | 0 | 0 | 0 | 0 | 0 | 0 | 0 | 0 | | | |
| Temperature (°F.) | 160 | 160 | 160 | 160 | 160 | 160 | 160 | 160 | 160 | 160 | 160 | 160 | 160 | 160 | 160 | 160 | | | |

TABLE 17

| Parts Per Million | 0 | 10 | 20 | 30 | 40 | 50 | 60 | 70 | 80 | 90 | 100 | 110 | 120 | 130 | 140 | 150 | 175 | 200 | 225 |
|---|---|---|---|---|---|---|---|---|---|---|---|---|---|---|---|---|---|---|---|
| Poly-carbonate Tile | 0 | 0 | 0 | 0 | 0 | 0 | 0 | 0 | 0 | 0 | 0 | 1 | 1 | 1 | 1 | 1 | | | |
| Poly-carbonate Bowl | 0 | 0 | 0 | 0 | 0 | 0 | 0 | 0 | 1 | 1 | 1 | 1 | 1 | 1 | 1 | 1 | | | |
| Glass Tumbler | 0 | 0 | 0 | 0 | 0 | 0 | 0 | 0 | 0 | 0 | 0 | 0 | 0 | 0 | 0 | 0 | | | |
| China Plate | 0 | 0 | 0 | 0 | 0 | 0 | 0 | 0 | 1 | 1 | 1 | 1 | 1 | 2 | 2 | 2 | | | |
| Melamine Plate | 0 | 0 | 0 | 0 | 0 | 0 | 0 | 1 | 1 | 1 | 1 | 1 | 1 | 2 | 2 | 2 | | | |
| Poly-propylene Plate | 0 | 0 | 0 | 0 | 0 | 0 | 0 | 1 | 1 | 1 | 1 | 1 | 2 | 2 | 2 | 2 | | | |
| Poly-propylene Cup | 0 | 0 | 0 | 0 | 0 | 1 | 1 | 1 | 1 | 2 | 2 | 2 | 2 | 2 | 2 | 2 | | | |
| Dinex Cup | 0 | 0 | 0 | 0 | 0 | 0 | 1 | 1 | 1 | 2 | 2 | 2 | 2 | 2 | 2 | 2 | | | |
| Dinex Bowl | 0 | 0 | 0 | 0 | 0 | 0 | 1 | 1 | 1 | 2 | 2 | 2 | 2 | 2 | 2 | 2 | | | |
| Poly-propylene Jug | 0 | 0 | 0 | 0 | 0 | 0 | 0 | 1 | 1 | 1 | 1 | 1 | 1 | 1 | 2 | 2 | | | |
| Poly Tray | 0 | 0 | 0 | 0 | 0 | 0 | 1 | 1 | 1 | 2 | 2 | 2 | 2 | 2 | 2 | 2 | | | |
| Poly-sulfonate Dish | 0 | 0 | 0 | 0 | 0 | 0 | 0 | 0 | 0 | 0 | 1 | 1 | 1 | 1 | 1 | 1 | | | |
| Poly-sulfonate Spoon | 0 | 0 | 0 | 0 | 0 | 0 | 0 | 0 | 0 | 0 | 1 | 1 | 1 | 1 | 1 | 1 | | | |
| Stainless Steel Knife | 0 | 0 | 0 | 0 | 0 | 0 | 0 | 0 | 0 | 1 | 1 | 1 | 1 | 2 | 2 | 2 | | | |
| Temperature (°F.) | 160 | 160 | 160 | 160 | 160 | 160 | 160 | 160 | 160 | 160 | 160 | 160 | 160 | 160 | 160 | 160 | | | |

EXAMPLE IV

The following formulations were made and evaluated. All additions are used at the same concentration of actives.

| | | Formula No. (Percent) | | | | |
|---|---|---|---|---|---|---|
| Item | Raw Material | 18 | 19 | 20 | 21 | 22 |
| 1 | EO/PO Block Terminated with PO (32% EO) | 19.744 | 19.744 | 19.744 | 19.744 | 19.744 |
| 2 | EO/PO Block Terminated with PO (39% EO) | 53.300 | 53.309 | 53.309 | 53.309 | 53.309 |
| 3 | SILWET L-720 (50%) | 2.626 | — | — | — | — |
| 4 | SILWET L-7001 (75%) | — | 1.751 | — | — | — |
| 5 | SILWET L-7200 (100%) | — | — | 1.313 | — | — |
| 6 | SILWET L-7230 (100%) | — | — | — | 1.313 | — |

-continued

| | | | | | | |
|---|---|---|---|---|---|---|
| 7 | SILWET L-7602 (100%) | — | — | — | — | 1.313 |
| 8 | Inerts to 100% | | | | | |

| | | 23 | 24 |
|---|---|---|---|
| 1 | EO/PO Block Terminated with PO (32% EO) | 19.744 | 19.744 |
| 2 | EO/PO Block Terminated with PO (39% EO) | 53.309 | 53.309 |
| 3 | SILWET L-7604 (100%) | 1.313 | — |
| 4 | SILWET L-7622 (100%) | — | 1.313 |
| 8 | Inerts to 100% | | |

TABLE 18

| PPM | 0 | 10 | 20 | 30 | 40 | 50 | 60 | 70 | 80 | 90 | 100 |
|---|---|---|---|---|---|---|---|---|---|---|---|
| Polycarbonate Tile | 0 | 0 | 0 | 0 | 0 | 1 | 1 | 1 | | | 2 |
| Polycarbonate Bowl | 0 | 0 | 0 | 0 | 0 | 0 | 1 | 1 | | | 1 |
| Glass Tumbler | 0 | 0 | 0 | 0 | 0 | 0 | 1 | 1 | | | 2 |
| China Plate | 0 | 0 | 0 | 0 | 1 | 1 | 1 | 2 | | | 2 |
| Melamine Plate | 0 | 0 | 0 | 0 | 0 | 1 | 1 | 1 | | | 1 |
| Polypropylene Plate | 0 | 0 | 0 | 0 | 0 | 1 | 1 | 1 | | | 1 |
| Polypropylene Cup | 0 | 0 | 0 | 1 | 1 | 2 | 2 | 2 | | | 2 |
| Dinex Cup | 0 | 0 | 0 | 1 | 1 | 2 | 2 | 2 | | | 2 |
| Dinex Bowl | 0 | 0 | 0 | 0 | 1 | 2 | 2 | 2 | | | 2 |
| Polypropylene Jug | 0 | 0 | 0 | 0 | 1 | 1 | 1 | 1 | | | 1 |
| Poly Tray (Cambro) | 0 | 0 | 0 | 0 | 0 | 0 | 0 | 1 | | | 1 |
| Polysulfonate Dish | 0 | 0 | 0 | 0 | 0 | 1 | 1 | 2 | | | 2 |
| Polysulfonate Spoon | 0 | 0 | 0 | 0 | 0 | 1 | 1 | 2 | | | 2 |
| Stainless Steel Knife | 0 | 0 | 0 | 0 | 0 | 2 | 2 | 2 | | | 2 |
| Temp (F.) | 160 | 160 | 160 | 160 | 160 | 160 | 160 | 160 | | | 160 |

TABLE 19

| PPM | 0 | 10 | 20 | 30 | 40 | 50 | 60 | 70 | 80 | 90 | 100 |
|---|---|---|---|---|---|---|---|---|---|---|---|
| Polycarbonate Tile | 0 | 0 | 0 | 0 | D | 0 | 0 | 1 | 1 | | 1 |
| Polycarbonate Bowl | 0 | 0 | 0 | 0 | 0 | 0 | 0 | 0 | 1 | | 1 |
| Glass Tumbler | 0 | 0 | 0 | 0 | 0 | 0 | 0 | 1 | 1 | | 2 |
| China Plate | 0 | 0 | 0 | 0 | 0 | 0 | 1 | 1 | 2 | | 2 |
| Melamine Plate | 0 | 0 | 0 | 0 | 0 | 1 | 1 | 1 | 1 | | 2 |
| Polypropylene Plate | 0 | 0 | 0 | 0 | 0 | 1 | 1 | 2 | 2 | | 2 |
| Polypropylene Cup | 0 | 0 | 0 | 0 | 1 | 1 | 2 | 2 | 2 | | 2 |
| Dinex Cup | 0 | 0 | 0 | 0 | 0 | 1 | 2 | 2 | 2 | | 2 |
| Dinex Bowl | 0 | 0 | 0 | 0 | 1 | 1 | 2 | 2 | 2 | | 2 |
| Polypropylene Jug | 0 | 0 | 0 | 0 | 0 | 0 | 1 | 1 | 1 | | 1 |
| Poly Tray (Carnbro) | 0 | 0 | 0 | 0 | 0 | 0 | 0 | 0 | 1 | | 1 |
| Polysulfonate Dish | 0 | 0 | 0 | 0 | 0 | 0 | 1 | 0 | 1 | | 1 |
| Polysulfonate Spoon | 0 | 0 | 0 | 0 | 0 | 0 | 1 | 0 | 1 | | 1 |
| Stainless Steel Knife | 0 | 0 | 0 | 0 | 0 | 0 | 2 | 1 | 1 | | 2 |
| Temp (F.) | 160 | 160 | 160 | 160 | 160 | 160 | 160 | 160 | 160 | | 160 |

TABLE 20

| PPM | 0 | 10 | 20 | 30 | 40 | 50 | 60 | 70 | 80 | 90 | 100 |
|---|---|---|---|---|---|---|---|---|---|---|---|
| Polycarbonate Tile | 0 | 0 | 0 | 0 | 0 | 0 | 1 | 1 | 1 | | 1 |
| Polycarbonate Bowl | 0 | 0 | 0 | 0 | 0 | 0 | 0 | 1 | 1 | | 1 |
| Glass Tumbler | 0 | 0 | 0 | 0 | 0 | 0 | 0 | 1 | 2 | | |
| China Plate | 0 | 0 | 0 | 0 | 0 | 0 | 1 | 1 | 1 | | 2 |
| Melamine Plate | 0 | 0 | 0 | 0 | 1 | 1 | 1 | 1 | 1 | | 2 |
| Polypropylene Plate | 0 | 0 | 0 | 0 | 0 | 1 | 1 | 1 | 1 | | 2 |
| Polypropylene Cup | 0 | 0 | 0 | 0 | 1 | 1 | 2 | 2 | 2 | | 2 |
| Dinex Cup | 0 | 0 | 0 | 0 | 1 | 1 | 2 | 2 | 2 | | 2 |
| Dinex Bowl | 0 | 0 | 0 | 0 | 0 | 1 | 2 | 2 | 2 | | 2 |
| Polypropylene Jug | 0 | 0 | 0 | 0 | 0 | 0 | 1 | 1 | 1 | | 1 |
| Poly Tray (Cambro) | 0 | 0 | 0 | 0 | 0 | 0 | 0 | 1 | 1 | | 1 |
| Polysulfonate Dish | 0 | 0 | 0 | 0 | 0 | 0 | 0 | 1 | 1 | | 2 |
| Polysulfonate Spoon | 0 | 0 | 0 | 0 | 0 | 0 | 1 | 1 | 1 | | 2 |
| Stainless Steel Knife | 0 | 0 | 0 | 0 | 0 | 0 | 1 | 0 | 2 | | 2 |
| Temp (F.) | 160 | 160 | 160 | 160 | 160 | 160 | 160 | 160 | 160 | | 160 |

TABLE 21

| PPM | 0 | 10 | 20 | 30 | 40 | 50 | 60 | 70 | 80 | 90 | 100 |
|---|---|---|---|---|---|---|---|---|---|---|---|
| Polycarbonate Tile | 0 | 0 | 0 | 0 | 0 | 0 | 0 | 0 | 1 | | 1 |
| Polycarbonate Bowl | 0 | 0 | 0 | 0 | 0 | 0 | 1 | 1 | 1 | | 1 |
| Glass Tumbler | 0 | 0 | 0 | 0 | 0 | 0 | 1 | 1 | 2 | | 2 |
| China Plate | 0 | 0 | 0 | 0 | 0 | 0 | 1 | 1 | 1 | | 2 |
| Melamine Plate | 0 | 0 | 0 | 0 | 0 | 1 | 1 | 1 | 1 | | 2 |
| Polypropylene Plate | 0 | 0 | 0 | 0 | 0 | 1 | 1 | 1 | 1 | | 2 |
| Polypropylene Cup | 0 | 0 | 0 | 0 | 1 | 1 | 2 | 2 | 2 | | 2 |
| Dinex Cup | 0 | 0 | 0 | 0 | 0 | 1 | 1 | 2 | 2 | | 2 |
| Dinex Bowl | 0 | 0 | 0 | 0 | 0 | 1 | 1 | 2 | 2 | | 2 |
| Polypropylene Jug | 0 | 0 | 0 | 0 | 0 | 0 | 1 | 1 | 1 | | 1 |
| Poly Tray (Cambro) | 0 | 0 | 0 | 0 | 0 | 0 | 0 | 1 | 1 | | 1 |
| Polysulfonate Dish | 0 | 0 | 0 | 0 | 0 | 0 | 0 | 0 | 0 | | 1 |
| Polysulfonate Spoon | 0 | 0 | 0 | 0 | 0 | 0 | 0 | 1 | 1 | | 1 |
| Stainless Steel Knife | 0 | 0 | 0 | 0 | 0 | 0 | 1 | 2 | 2 | | 2 |
| Temp (F.) | 160 | 160 | 160 | 160 | 160 | 160 | 160 | 160 | 160 | | 160 |

TABLE 22

| PPM | 0 | 10 | 20 | 30 | 40 | 50 | 60 | 70 | 80 | 90 | 100 |
|---|---|---|---|---|---|---|---|---|---|---|---|
| Polycarbonate Tile | 0 | 0 | 0 | 0 | 0 | 0 | 1 | 1 | 1 | | 1 |
| Polycarbonate Bowl | 0 | 0 | 0 | 0 | 0 | 0 | 0 | 1 | 1 | | 1 |
| Glass Tumbler | 0 | 0 | 0 | 0 | 0 | 0 | 1 | 1 | 2 | | 2 |
| China Plate | 0 | 0 | 0 | 0 | 0 | 0 | 1 | 1 | 1 | | 2 |
| Melamine Plate | 0 | 0 | 0 | 0 | 0 | 1 | 1 | 1 | 1 | | 2 |
| Polypropylene Plate | 0 | 0 | 0 | 0 | 0 | 1 | 1 | 1 | 1 | | 2 |
| Polypropylene Cup | 0 | 0 | 0 | 0 | 0 | 1 | 1 | 2 | 2 | | 2 |
| Dinex Cup | 0 | 0 | 0 | 0 | 0 | 1 | 1 | 2 | 2 | | 2 |
| Dinex Bowl | 0 | 0 | 0 | 0 | 0 | 1 | 1 | 2 | 2 | | 2 |
| Polypropylene Jug | 0 | 0 | 0 | 0 | 0 | 0 | 1 | 1 | 1 | | 1 |
| Poly Tray (Cambro) | 0 | 0 | 0 | 0 | 0 | 0 | 0 | 0 | 1 | | 1 |
| Polysulfonate Dish | 0 | 0 | 0 | 0 | 0 | 0 | 0 | 0 | 0 | | 1 |
| Polysulfonate Spoon | 0 | 0 | 0 | 0 | 0 | 0 | 0 | 0 | 0 | | 1 |
| Stainless Steel Knife | 0 | 0 | 0 | 0 | 0 | 1 | 1 | 2 | 2 | | 2 |
| Temp (F.) | 160 | 160 | 160 | 160 | 160 | 160 | 160 | 160 | 160 | | 160 |

TABLE 23

| PPM | 0 | 10 | 20 | 30 | 40 | 50 | 60 | 70 | 80 | 90 | 100 |
|---|---|---|---|---|---|---|---|---|---|---|---|
| Polycarbonate Tile | 0 | 0 | 0 | 0 | 0 | 0 | 0 | 0 | 1 | | 2 |
| Polycarbonate Bowl | 0 | 0 | 0 | 0 | 0 | 0 | 0 | 0 | 0 | | 1 |
| Class Tumbler | 0 | 0 | 0 | 0 | 0 | 0 | 1 | 1 | 1 | | 2 |
| China Plate | 0 | 0 | 0 | 0 | 0 | 0 | 1 | 1 | 1 | | 2 |
| Melamine Plate | 0 | 0 | 0 | 0 | 0 | 0 | 1 | 1 | 1 | | 2 |
| Polypropylene Plate | 0 | 0 | 0 | 0 | 0 | 0 | 1 | 1 | 1 | | 2 |
| Polypropylene Cup | 0 | 0 | 0 | 0 | 0 | 1 | 1 | 1 | 2 | | 2 |
| Dinex Cup | 0 | 0 | 0 | 0 | 0 | 1 | 1 | 1 | 2 | | 2 |
| Dinex Bowl | 0 | 0 | 0 | 0 | 0 | 1 | 1 | 1 | 2 | | 2 |
| Polypropylene Jug | 0 | 0 | 0 | 0 | 0 | 0 | 1 | 1 | 1 | | 1 |
| Poly Tray (Cambro) | 0 | 0 | 0 | 0 | 0 | 0 | 0 | 0 | 1 | | 1 |
| Polysulfonate Dish | 0 | 0 | 0 | 0 | 0 | 0 | 0 | 0 | 0 | | 1 |
| Polysulfonate Spoon | 0 | 0 | 0 | 0 | 0 | 0 | 0 | 0 | 0 | | 1 |
| Stainless Steel Knife | 0 | 0 | 0 | 0 | 0 | 0 | 1 | 1 | 2 | | 2 |
| Temp (F.) | 160 | 160 | 160 | 160 | 160 | 160 | 160 | 160 | 160 | | 160 |

TABLE 24

| PPM | 0 | 10 | 20 | 30 | 40 | 50 | 60 | 70 | 80 | 90 | 100 |
|---|---|---|---|---|---|---|---|---|---|---|---|
| Polycarbonate Tile | 0 | 0 | 0 | 0 | 0 | 0 | 0 | 0 | 0 | | 1 |
| Polycarbonate Bowl | 0 | 0 | 0 | 0 | 0 | 0 | 0 | 0 | 0 | | 1 |
| Glass Tumbler | 0 | 0 | 0 | 0 | 0 | 0 | 0 | 0 | 1 | | 2 |
| China Plate | 0 | 0 | 0 | 0 | 0 | 1 | 1 | 1 | 1 | | 2 |
| Melamine Plate | 0 | 0 | 0 | 0 | 0 | 1 | 1 | 1 | 1 | | 2 |
| Polypropylene Plate | 0 | 0 | 0 | 0 | 0 | 1 | 1 | 1 | 1 | | 2 |
| Polypropylene Cup | 0 | 0 | 0 | 0 | 1 | 1 | 1 | 1 | 1 | | 2 |
| Dinex Cup | 0 | 0 | 0 | 0 | 1 | 1 | 1 | 1 | 1 | | 2 |
| Dinex Bowl | 0 | 0 | 0 | 0 | 1 | 1 | 1 | 1 | 1 | | 2 |

TABLE 24-continued

| PPM | 0 | 10 | 20 | 30 | 40 | 50 | 60 | 70 | 80 | 90 | 100 |
|---|---|---|---|---|---|---|---|---|---|---|---|
| Polypropylene Jug | 0 | 0 | 0 | 0 | 0 | 0 | 0 | 0 | 1 | | 1 |
| Poly Tray (Cambro) | 0 | 0 | 0 | 0 | 0 | 0 | 0 | 0 | 0 | | 1 |
| Polysulfonate Dish | 0 | 0 | 0 | 0 | 0 | 0 | 0 | 0 | 0 | | 1 |
| Polysulfonate Spoon | 0 | 0 | 0 | 0 | 0 | 0 | 0 | 0 | 0 | | 1 |
| Stainless Steel Knife | 0 | 0 | 0 | 0 | 0 | 1 | 1 | 1 | 1 | | 2 |
| Temp (F.) | 160 | 160 | 160 | 160 | 160 | 160 | 160 | 160 | 160 | | 160 |

TABLE 25

Characteristics of Nonionic Polydimethylsiloxane Polymers and Test Results

| Product | Ratio (EO/PO) | Cap | Mol Wt | Parts Per Million |
|---|---|---|---|---|
| Silwet L-77 | ALL EO | Me | 600 | 60* |
| Silwet L-720 | 50/50 | Bu | 12000 | 50* |
| Silwet L-7001 | 40/60 | Me | 20000 | 70* |
| Silwet L-7200 | 75/25 | H | 19000 | 60* |
| Silwet L-7230 | 40/60 | H | 29000 | 60* |
| Silwet L-7602 | ALL EO | Me | 3000 | 70* |
| Silwet L-7604 | ALL EO | H | 4000 | 80* |
| Silwet L-7622 | ALL EO | Me | 10000 | 90* |
| ABIL-B-8878 | ALL EO | H | 600 | 60* |
| ABIL-B-8847 | 80/20 | H | 800 | 60* |
| ABIL-B-8842 | 60/40 | H | 950 | 50* |

*Concentration of rinse aid required for initial complete sheeting of a plastic substrate.

TABLE 26

A Key to the Dishware Substrates used for the Plastic Rinse Additive Sheeting Test

| Abbreviated Title | Type of Dishware |
|---|---|
| PC Tile | Polycarbonate Tile |
| PC Bowl | Polycarbonate Bowl |
| Glass | Glass Tumbler |
| China Plt | China Plate |
| Mel Plt | Melamine Plate |
| P3 Plt | Polypropylene Plate |
| P3 Plt | Polypropylene Cup |
| Dnx Cup | Filled Polypropylene Cup |
| Dnx Bowl | Filled Polypropylene Bowl |
| P3 Jug | Polypropylene Jug |
| Poly Try | Polyester Resin Tray |
| PS (dish) | Polysulfone Dish |
| PS Spoon | Polysulfone Spoon |
| SS Knife | Stainless Steel Knife |

What is claimed is:

1. A rinse aid composition comprising:

(a) about 0.1 to about 10 wt-% of a fluorinated hydrocarbon nonionic surfactant;

(b) about 0.1 to about 10 wt-% of a polyalkylene oxide-modified polydimethylsiloxane or a polybetaine-modified polysiloxane of the formula

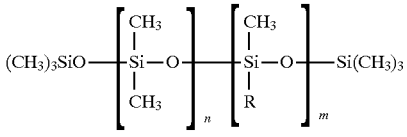

wherein R is —$(CH_2)_3$—O—(EO)—(PO)—Z or

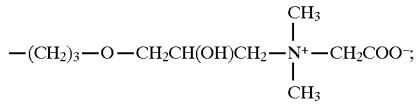

n is 0 or ≧1; m is at least 1, Z is hydrogen or alkyl of 1–6 carbon atoms and the weight ratio in % of EO:PO may vary from 100:0 to 0:100; and (c) about 2–90 wt-% of a nonionic block copolymer of ethylene oxide and propylene oxide or a mixture thereof, wherein said composition on dilution forms an aqueous rinse for providing sheeting on plasticware.

2. The composition of claim 1, wherein the fluorinated hydrocarbon surfactant is an ethoxylated fluoroaliphatic sulfonamide alcohol, a fluoroaliphatic polyoxyethylene ethanol, a fluoroaliphatic alkoxylate or a fluoroaliphatic ester.

3. The composition of claim 2, wherein the ethoxylated fluoroaliphatic sulfonamide alcohol is of the formula $$RSO_2N(C_2H_5)(CH_2CH_2O)_xH$$

wherein R is $C_pF_{2p+1}$ in which p is 6 to 10 and x may vary from 10 to 20.

4. The composition of claim 3, wherein p is 8 and x is 14.

5. The composition of claim 1, wherein n is 0 or 1, m is 1; R is —$(CH_2)_3$—O—(EO)—(PO)—Z, in which Z is hydrogen, methyl or butyl, and the weight ratio in % of EO to PO is 100:0 to 20:80.

6. The composition of claim 1, wherein n is ≧1; m is at least 1 and R is

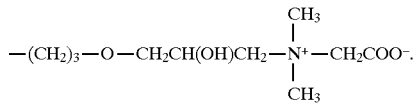

7. The composition of claim 1, wherein the composition further comprises about 1 to 20 wt-% of a hydrotrope.

8. The composition of claim 7, wherein the hydrotrope is an aromatic sulfonic acid or salt thereof.

9. A rinse aid composition comprising:

(a) about 5 to 50 wt-% of a sorbitan fatty acid ester containing greater than about 1 5 moles of alkylene oxide per mole of sorbitan;

(b) about 0.2 to 25 wt-% of a defoamer composition selected from the group consisting of an alkali metal or alkaline earth metal salt of a fatty acid, a silicone, a fatty acid ester of glycerol, and mixtures thereof;

(c) about 0.1 to 10 wt-% of an ethoxylated fluoroaliphatic sulfonamide alcohol; and (d) about 0.1 to 10 wt-% of a polyalkylene oxide-modified polydimethylsiloxane or a polybetaine-modified polysiloxane of the formula

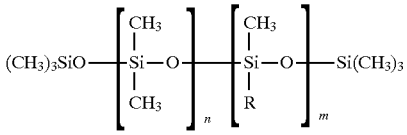

wherein R is —$(CH_2)_3$—O—(EO)—(PO)—Z or

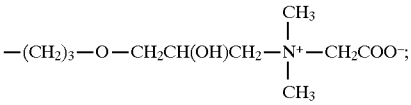

n is 0 or ≧1, m is at least 1, Z is hydrogen or alkyl of 1–6 carbon atoms and the weight ratio in % of EO to PO is 100:0 to 0:100, wherein said composition on dilution forms an aqueous rinse for providing sheeting on plasticware.

10. The composition of claim 9, wherein the ethoxylated fluoroaliphatic sulfonamide alcohol is of the formula $$RSO_2N(C_2H_5)(CH_2CH_2O)_xH$$

wherein R is $C_pF_{2p+1}$ in which p is 8, and x is 14.

11. The composition of claim 9, wherein n is 0 or 1, m is 1; R is —$(CH_2)_3$—O—(EO)—(PO)—Z, in which Z is hydrogen, methyl or butyl, and the weight ratio in % EO to PO is 100:0 to 20:80.

12. The composition of claim 9, wherein n is ≧1; m is at least 1 and R is

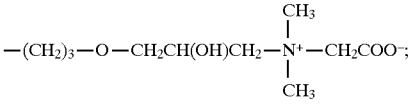

13. A solid block rinse aid composition comprising:

(a) about 0.1 to about 10 w-% of a fluorinated hydrocarbon nonionic surfactant;

(b) about 0.1 to about 10 wt-% of a polyalkylene oxide-modified polydimethylsiloxane or a polybetaine-modified polysiloxane of the formula

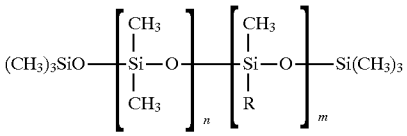

wherein R is —$(CH_2)_3$—O—(EO)—(PO)—Z or

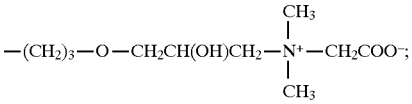

n is 0 or ≧1; m is at least 1, Z is hydrogen or alkyl of 1–6 carbon atoms and the weight ratio in % of EO:PO may vary from 100:0 to 0:100;

(c) about 2–90 wt-% of a nonionic block copolymer of ethylene oxide and propylene oxide or a mixture thereof; and (d) a solidifier, wherein said composition on dilution forms an aqueous rinse for providing sheeting on plasticware.

14. The composition of claim 13 wherein the solidifier is polyethylene glycol or an inclusion complex comprising urea and a nonionic polyethylene or polypropylene oxide polymer.

15. The composition of claim 14 wherein the solidifies is polyethylene glycol.

* * * * *

UNITED STATES PATENT AND TRADEMARK OFFICE

CERTIFICATE OF CORRECTION

PATENT NO. : 5,880,089

DATED : MARCH 9, 1999

INVENTOR(S) : LENTSCH ET AL.

It is certified that error appears in the above-identified patent and that said Letters Patent is hereby corrected as shown below:

Title page, [75] Inventors: insert —, Minneapolis— after "Victor F. Man"

Front page, [75] Inventors: "both of Minneapolis" should read —St. Paul—

Col. 15, line 45: insert title —EXAMPLE II—

Col. 18, Table 6, Row "Temperature (°F.)", Column "130": "i6D" should read —160—

Col. 25, Table 11, Row "China Plate", Column "30": "a" should read —0—

Col. 27, Table 13: column heading "E0" should read —60—

Col. 33, Table 19, Row "Polycarbonate Tile", Column "40": "D" should read —0—

Col. 35, Table 22, Row "Polycarbonate Bowl", Column "70": "1" should read —0—

Col. 40, line 34, claim 15: "solidifies" should read —solidifier—

Signed and Sealed this

Twenty-fourth Day of October, 2000

*Attest:*

Q. TODD DICKINSON

*Attesting Officer*

*Director of Patents and Trademarks*